US005778651A

United States Patent [19]

Špindler et al.

[11] Patent Number: 5,778,651

[45] Date of Patent: Jul. 14, 1998

[54] METHOD OF, AND DEVICE FOR, SPINNING-IN YARN ON AN OPEN-END SPINNING MACHINE

[75] Inventors: Zdeněk Špindler, Němcové ; Vojtěch Novotný , Dukelská, both of Czechoslovakia

[73] Assignee: Rieter Elitex a.s. Ústí nad Orlicí , Czechoslovakia

[21] Appl. No.: 730,198

[22] Filed: Oct. 15, 1996

[30] Foreign Application Priority Data

Oct. 16, 1995 [CS] Czechoslovakia ..... 2694-95

[51] Int. Cl.[6] ..... D01H 13/26

[52] U.S. Cl. ..... 57/263

[58] Field of Search ..... 57/263, 261, 269, 57/278, 404

[56] References Cited

U.S. PATENT DOCUMENTS

| | | | |
|---|---|---|---|
| 4,248,037 | 2/1981 | Martin et al. | 57/263 |
| 4,327,546 | 5/1982 | Derichs et al. | 57/263 |
| 4,628,684 | 12/1986 | Morita et al. | 57/263 |
| 4,676,060 | 6/1987 | Stahlecker et al. | 57/263 |
| 4,716,718 | 1/1988 | Gobbles et al. | 57/263 |
| 4,891,933 | 1/1990 | Raasch | 57/263 X |
| 5,193,332 | 3/1993 | Kriegler et al | 57/263 |
| 5,303,538 | 4/1994 | Pagura et al. | 57/263 |

*Primary Examiner*—C. D. Crowder
*Assistant Examiner*—Tina R. Taylor
*Attorney, Agent, or Firm*—Ostrolenk, Faber, Gerb & Soffen, LLP

[57] ABSTRACT

Method and apparatus for spinning-in yarn on an open end spinning machine following a yarn rupture, wherein the machine includes a plurality of operating units which wind yarn on respective bobbins and an attending device movable along the operating units to the unit at which a rupture occurred. Upon a yarn rupture, the winding of the bobbin is halted, and the bobbin is permitted to be unwound a metered length. A detecting nozzle detects the yarn end and sucks in the yarn end and moves away from the bobbin. A catching arm supports the yarn. A tension roller receives the yarn on it. The tension roller is located on a spinning head which is swingable from a position toward the bobbin to a position toward the rotor and the head is then movable to move the yarn on the roller toward the rotor. A clamp on the spinning head clamps the yarn and a trimmer trims the yarn to form the yarn end. An ancillary compensator at the spinning head deflects the yarn to compensate and then releases the yarn. The yarn end is sucked into the rotor where it is blended with the incoming fibers to reform the yarn which is then again wound on the bobbin.

24 Claims, 16 Drawing Sheets

METHOD OF, AND DEVICE FOR, SPINNING-IN YARN ON AN OPEN-END SPINNING MACHINE

TECHNICAL FIELD

The invention relates to a method of spinning-in yarn by means of an attending device on an open-end spinning machine after a thread rupture. In the method, the yarn end is first detected on a raised bobbin and is sucked into a detecting nozzle. Then a yarn end required for spinning-in is unwound from the bobbin while the yarn is moved towards the spinning unit. At the end of the metered length of yarn, a yarn spinning end is made. In a first step, by means of underpressure, the yarn spinning end is partly introduced into the spinning rotor. In a subsequent second step, the yarn end is sunk onto the collecting groove of the spinning rotor where it is joined by the fibers produced in the collecting groove from a fiber band, whereupon the yarn delivery and winding are set in action.

The invention also relates to a device for carrying out the method on an open-end spinning machine by means of an attending device adapted to travel along the operating units of the machine and to stop at a selected operating unit. The device is fitted with a yarn end detecting device with a detecting nozzle that is adapted to be placed near the circumference of the bobbin. A yarn transfer device brings yarn to the spinning unit, with means for imparting rotation to the bobbin, and with means for producing the yarn spinning-in end.

BACKGROUND OF THE INVENTION

Known attending devices for open-end spinning machines are fitted on the operating unit for the resumption of spinning with a yarn end detecting device for a bobbin occupying its raised position. The detecting device includes a detecting nozzle adapted to be connected to an underpressure source and to be placed near the bobbin circumference. A yarn transfer device is coupled with the detecting device for bringing the yarn to the spinning unit. Means for unwinding a metered yarn length required for spinning-in is coupled with the detecting device. The attending device also comprises means for trimming the yarn at a predetermined section to produce a yarn end suitable for spinning-in and means for introducing the yarn into the spinning rotor and for letting the yarn end sink onto the collecting groove of the spinning rotor.

For instance, in CS 212 263 (DE OS 26 20 805) or in U.S. Pat. No. 4,724,665, at the beginning of the spinning-in process after a yarn rupture, the detecting nozzle first swings towards the bobbin and sucks-in the yarn end while the yarn bobbin is turned in the unwinding direction.

After the yarn end has been sucked-in, the detecting nozzle moves back, and the yarn end is held in the nozzle by underpressure, and the yarn is unwound from the bobbin. In the end position of the detecting nozzle, the yarn is gripped in front of the detecting nozzle by a gripper of a drawing lever. With the yarn gripped in the gripper, the drawing lever then swings so that one yarn section is unwound from the bobbin and the other is drawn out of the detecting nozzle. The yarn section between the bobbin and the gripper of the drawing lever is then introduced between ancillary draw-off rollers of the attending device which begin to turn in the direction of the unwinding of yarn.

When the drawing lever has swung into its end position, the yarn between the ancillary draw-off rollers of the attending device and the gripper of the drawing lever gets caught by a swinging transfer lever, fixed in its clamp. The transfer lever then swings towards the spinning unit, and the yarn between the gripper of the drawing lever and the clamp of the transfer lever is trimmed by a grinding device thus creating a yarn end for spinning-in in the yarn section between the bobbin and the transfer lever. The swinging motion of the transfer lever brings the yarn end to the spinning unit so as to be sucked into a draw-off tube of the spinning device due to the underpressure existing in the spinning device. Then the clamp of the transfer lever opens and the ancillary draw-off rollers of the attending device unwind the last yarn length section required for the spinning-in from the bobbin. Due to the underpressure, the yarn end arrives then as far as the collecting groove of the spinning rotor and gets joined with the fiber band. The motion of the ancillary draw-off rollers of the attending device is then reversed, and they begin to draw the yarn from the spinning device. Simultaneously, an ancillary drive roller of the attending device begins to rotate the bobbin in the winding direction. When the speeds of all of the parts of the operating unit have reached their operating level, the yarn is handed over from the mechanisms of the attending device to the mechanisms of the attended operating unit of the machine.

The drawback of this solution is the complicated way the yarn is handed over in the process of forming the yarn end length required for the spinning-in operation. This leads to inaccurate operation of the attending device which fails to reliably grip the yarn by the due mechanism and to reliably transfer it to the subsequent operation. Thus the reliability of the attending device for the spinning-in process is affected. Another drawback is that already in the first stage, a long yarn section must be sucked into the detecting nozzle in order to enable it to be drawn out of the detecting nozzle in the next operation. This particularly increases the time interval required for attending one operation unit. Another drawback consists in the great distance between the ancillary draw-off rollers of the attending device and the mouth of the draw-off tube. This produces the risk that during the last reverse unwinding motion of the ancillary draw-off rollers of the attending device, due to various influences and low tension on this free section of the unwound yarn length, it fails to be sucked into the draw-off tube and, consequently, fails to be spun-in.

The operation of handing over the yarn, after the spinning-in, from the means of the attending device into the means of the attended operating unit of the machine is very complicated. Also, the steps of handing over the winding bobbin, which has been set in rotating motion by the drive roller of the attending device, to the drive roller of the winding device of the attended operating unit of the machine is very complicated.

Some of the drawbacks of this solution have been removed by the method of, and device for, spinning-in yarn, disclosed in CZ 277 393 (DE OS 32 02 428). As in the preceding solution, the yarn end on the bobbin is first sucked into the detecting nozzle while the bobbin turns in the unwinding direction. The detecting nozzle has a longitudinal slot. After the yarn is sucked into the end sections of the detecting nozzle, the yarn partly gets out through the slot so as to form a chord between the front end of the detecting nozzle in its detecting position and the end part of the detecting nozzle. That longitudinal slot can be obturatable. When the detecting nozzle has swung to its rear position, the yarn is stretched between the bobbin and the end part of the detecting nozzle. In this position, the yarn is gripped between a pair of ancillary rollers, which are rotatably mounted on the extremity of a lever seated on the attending device. The yarn is thereby and in a known way interrupted between the ancillary rollers and the detecting nozzle, and a yarn end for spinning-in is formed. After swivelling of the lever with the ancillary rollers over the spinning unit, the yarn end is sucked into the draw-off tube of the spinning device. Then the ancillary rollers turn in the reverse direction for a time interval so as to move the yarn end to a predetermined distance from the collecting groove of the spinning rotor. After the reverse motion stops, the ancillary rollers open and release the yarn which is then released from the gripping means of the attending device. These means transfer the yarn end onto the collecting groove of the spinning rotor where it joins the fiber band. The means of the attending device then set the raised bobbin in rotating motion in the winding direction so that the yarn is drawn-off from the spinning device by means of the winding bobbin. Only after the winding and spinning parameters have been stabilized, the yarn drawing-off is handed over to the drawing-off device of the attended operating unit and the winding bobbin is tilted to the drive roller of the attended operating unit, thus concluding the spinning-in process.

The drawback of this solution is that the longitudinal slot reduces the suction in the mouth of the detecting nozzle and thereby also the reliability of the yarn end detection on the bobbin. The design of the detecting nozzle is complicated with an obturatable slot. Another drawback is the considerable distance between the bobbin and the point where the yarn is taken over by the ancillary rollers, since the yarn tension in this section, under the conditions of workshop operation, is subject to changes due to impurities which reduces the reliability with which the yarn is handed over to the ancillary rollers.

The means of the attending device fail to instantly impart full operating speed to the bobbin, in particular to a bobbin with a considerable amount of yarn already wound-on it. Therefore, in this solution as well as in other similar solutions, the spinning-in takes place at a reduced rotation speed of the spinning rotor, which somewhat reduces the winding speed at first. After the spinning-in, the speed of the spinning rotor gradually increases up to the operating speed. The rotation speed of the bobbin which draws-off the yarn from the rotor must also increase. This puts heavy demands on the complexity of the attending device and increases the total time interval required for spinning-in the operating unit after a yarn rupture. If the increase in speed is not accompanied by a corresponding change in speed of the sliver feed into the spinning unit, the spun-in yarn will be thicker than of yarn spun at full speed. A device permitting adjustment of the speed with which the sliver is fed into the spinning unit would considerably increase the complexity of both the attending device and the attended operating unit.

In another known device, after a yarn rupture on an open-end spinning machine, the detecting nozzle first detects and sucks-in the yarn end on a bobbin and the nozzle then moves away from the bobbin. In the rear position of the detecting nozzle, the yarn extending between the bobbin and the detecting nozzle is caught by a transfer means by which the yarn is first interrupted and the newly created yarn end is sucked-in. After a yarn length escaping any accurate specification has been sucked-in, the transfer means with the yarn moves to the spinning unit. During this movement, the yarn is led into an ancillary hook which catches the yarn and then swings away from the bobbin. The rear position of the ancillary hook defines the metered yarn length required for the spinning-in.

When the yarn length required for spinning-in has been produced, it is gripped in front of the point of suction into the transfer means and is trimmed between the gripping and the suction points to create a yarn end for spinning-in which is then fed into the area of the draw-off tube of the spinning unit and sucked into that tube. After this end has been sucked-in the yarn is released from its gripping state by mechanisms of the transfer means, and the ancillary hook moves towards the bobbin to its spinning-in position. At this, the yarn being released is sucked into the draw-off tube of the spinning unit until in the spinning-in position of the ancillary hook the yarn end comes to lie in the area where the draw-off tube goes over into the inner space of the spinning rotor.

After the spinning-in, the yarn is released from the ancillary hook with the released length corresponding to the remaining distance between the yarn end and the collecting groove of the spinning rotor. When the yarn end has reached the collecting groove, it joins the fiber band. Then the spun yarn begins to be drawn-off from the spinning rotor by the means of the attending device. Only after the draw-off and winding situation has been stabilized, the yarn in process of spinning is handed over from the means of the attending device to the draw-off mechanism of the machine.

The drawbacks of this solution are the complexity of the operating cycle because during the transfer of the yarn end from the bobbin to the spinning unit, the yarn end there is sucking-in twice, namely, first into the detecting nozzle and secondly into the transfer means. This additionally requires trimming the yarn while it is being handed over from the detecting nozzle into the transfer means. Such operations increase the time consumption of the operating cycle. Further, the sucking of the newly created yarn end into the transfer means can even lead to spinning-in failure. After that, the attending device is no longer able to detect the yarn end on the bobbin because if the attempt to suck the newly created yarn end into the transfer device has failed, that yarn end gets wound onto the bobbin then revolving in the unwinding direction. During a following spinning-in attempt, the bobbin revolves in the unwinding direction, and the yarn end wound on the bobbin as stated above cannot be caught by the detecting nozzle. Then the machine operator must remove the defect.

Another drawback concerns the irregularity of yarn tension during the metering of the yarn length required for the spinning-in and creating the yarn end for the spinning-in process. This produces fluctuations of the yarn section length required for spinning-in and in irregular spinning-in junction points, and in extreme cases, it even produces failed spinning-in attempts when the metered yarn section is either too short, so that the yarn end fails to reach the collecting groove, or too long and gets twisted away in the rotor either before or at the beginning of the spinning-in process.

A further serious drawback concerns the fact that the spun yarn is handed over from the draw-off means of the attending device to the draw-off means of the machine up to establishing stabilized draw-off and winding relations. This operation puts heavy demands on the speed synchronization of the means of the attending device and of the operating unit and often leads to yarn ruptures. Besides, the attending device is required to continuously remain at the attended operating unit even if the yarn spinning on the latter has already resumed. This further increases the required length of the time interval of its operating cycle.

The object of the invention is to reduce or fully eliminate the drawbacks of the existing systems of spinning-in yarn after its rupture on open-end spinning machines, and in particular to increase the reliability in the process of handing over the yarn between the mechanisms for creating the yarn end length required for the spinning-in process, to increase the metering accuracy of this length, and especially to simplify the spinning-in process so as to cut down the time interval required by the attending device to correct a yarn rupture on an operating unit. At the same time, problems connected with the handing over of the yarn from the attending device to the means of the attended operating unit are to be solved.

Principle of the invention

The above goal is achieved by the method of spinning-in yarn on an open-end spinning machine after a yarn rupture. After unwinding a yarn length required for spinning-in and after transferring the yarn towards the spinning unit, the yarn is acted upon by the attending device for guiding the yarn into its operating path through all means of the attended operating unit of the machine, except the yarn distributing device. Then before carrying out a second step of sinking the spinning-in yarn end onto the collecting groove of the spinning rotor, the yarn is acted upon by a deflecting means of the attending device. The deflecting means is between the spinning unit and the draw-off device of the attended operating unit of the machine. Upon stopping this acting, the yarn spinning-in end is sunk onto the collecting groove of the spinning rotor, whereupon the yarn begins to be acted upon by draw-off, monitoring and winding means of the attended operation station. The yarn is then handed over from the attending device to the distributing device of the operating station of the machine. This repeatedly achieves a constant quality and size of the spinning-in junction points on any operating station of the machine.

Thus spinning-in method reduces by 20 to 45% the time required for the attending device to repair a yarn rupture on an operating station of the machine, as compared with the known methods. It also solves problems connected with handing over the spun-in yarn from the attending device into the means of the attended operating unit of the machine.

In carrying out the method according to this invention, during the unwinding of the yarn length required for spinning-in, it is advantageous to apply a mechanical force to the yarn between the bobbin and the detecting nozzle acting in the direction of its unwinding to achieve a uniform yarn tension during its unwinding and to transfer up to the creation of the spinning-in yarn end.

Exposing the yarn to tension makes the metering of the yarn length required for spinning-in more accurate because during this handling, the yarn is constantly under tension and is thus protected from sudden tension changes.

In the method hereof, it is advantageous to embrace or wrap the yarn in the section between the bobbin and the detecting nozzle on a part of the circumference of a tension roller of the spinning-in head of the attending device. At least during a part of the interval in which the yarn length required for spinning-in is being unwound, that tension roller turns in the unwinding direction for imparting tension to the yarn. After the embracement, the yarn tension roller is tilted through 90°, so as to transfer the yarn to the spinning unit. The turning movement of the tension roller improves the yarn unwinding from the bobbin throughout the operation.

In the section of yarn between the bobbin and the tension roller, it is also advantageous to catch the yarn into an adjustable means of the attending device. The yarn freely passes through in the longitudinal direction. Then between the adjustable means and the detecting nozzle, the yarn is embraced around a section of the circumference of the tension roller. After that roller is tilted in the direction of (towards) the spinning unit, the yarn length required for spinning-in is metered. Then the turning of the bobbin in the unwinding direction is stopped. This fixes the metered length required for spinning-in.

During unwinding of the yarn length required for spinning-in, the tension roller can turn in the yarn unwinding direction interruptedly (intermittently) or at least before the moment when the yarn gets trimmed.

In carrying out the above methods, the tension roller can turn at variable speed.

It is also advantageous to clamp the yarn by means of a spinning-in clamp in the direction of the yarn unwinding in front of the tension roller. The turning movement of the tension roller stretches the yarn both before and after the clamping. Then the yarn is trimmed between the clamping point and the tension roller thus creating the spinning-in yarn end in the mechanically stretched yarn section.

Such mechanical yarn stretching in the section where it is to be trimmed permits both a constant yarn tension and a constant yarn path to be repeatedly obtained, at any operating station of the machine, and also the same metered yarn length after the spinning-in and the same shape of the spinning-in yarn end which is a substantial contribution to obtaining constant quality and shape of the spinning-in junction points.

In the preceding version of the method, it is advantageous after the yarn clamping for the adjustable means of the attending device to move towards the machine to its handing over position and for the yarn being released from the adjustable means in the section of the machine between the spinning-in clamp of the attending device and the draw-off mechanism of the attended operating station for the yarn to be taken over by an ancillary compensator of the attending device so as to place the yarn nearer to its regular path in the attended operating unit of the machine.

Placing the yarn reserve as near as possible to the spinning unit prevents faults arising during yarn handling when inserting and sinking the yarn end into the spinning rotor.

After the creation of the spinning-in end, it is helpful if the spinning-in yarn end is transferred by means of the spinning-in clamp into the area of action of the underpressure in the outlet aperture of the delivery tube of the spinning rotor, where the spinning-in end is sucked into the delivery tube. After that, the spinning-in clamp is opened and is positively turned back by means of an ancillary compensator so as to release yarn to be sucked into the spinning rotor. The yarn is then nearing its work path in the area of the delivery device of the attended operating station, and the spinning-in yarn end is partly inserted into the spinning rotor to a predetermined distance from its collecting groove.

In one variant of the preceding method, during reverse motion of the ancillary compensator, it stops in a deflecting position in which it acts as a yarn deflecting means of the attending device. The spinning-in clamp is moved outside the work path of the yarn and the ancillary compensator quickly moves back outside the work path of the yarn. This releases the yarn to enable it to move into its work path in the attended operating station, and its spinning-in end is permitted to sink onto the collecting groove of the spinning rotor.

In another variant of the preceding method, the spinning-in clamp is set to an ancillary deflecting position at which it acts as a yarn deflecting means of the attending device. The ancillary compensator completes its reverse motion outside the work path of the yarn for orienting the yarn to its work path in the delivery device of the attended operating station. The spinning-in clamp is moved outside the work path of the yarn thus releasing the yarn to its work path also between the outlet aperture of the delivery tube of the spinning rotor and the delivery device and this lets its spinning-in end sink onto the collecting groove of the spinning rotor.

Orienting the yarn to its work path prior to the yarn spinning-in permits use, after the spinning-in, for yarn delivery, monitoring, and winding, applicable means of the attended operating station of the machine, including possible paraffining means. This avoids faults and problems that arise when the yarn is handed over only after the spinning-in from the means of the attending device to the means of the operating station and that arise from permitting machines with operating stations equipped with paraffining or other yarn finishing means, to start the paraffining process from the beginning of the yarn delivery, and not only after the yarn has been handed over from the attending device means to the operating unit. Thus, the increased reliability is accompanied by a reduction in the length of the operating cycle.

The principle of a device for carrying out the method according to the invention is that the attending device is fitted with a device for metering the yarn length required for spinning-in, comprising a catching tie-rod mounted to be adjustable both across the yarn path between the bobbin and the detecting nozzle and in the plane perpendicular to the axis of rotation of the bobbin, and comprising an ancillary compensator coupled with drive means for forward and reverse motion and interfering under the delivery device of the attended operating station of the machine with both the yarn path in the attending device and with the work path of the yarn in the attended operating station.

The ancillary compensator can contain a compensation arm that is swingingly mounted on the attending device. That arm is coupled with an extension spring acting on the compensation arm in the direction of the yarn deflection from its path. That arm is also coupled with a reverse drive adapted to act on the compensation arm with a force greater than the force exerted by the extension spring in the opposite direction.

The principle of the device for carrying out the method also is that the delivery device for the yarn comprises a rotatable guide (tension) roller having the yarn embraced on a part of its circumference and a drive coupled with that roller serving to impart to it the rotating motion while it is embraced by the yarn. This makes it possible (provision) to arrange the rotating motion as an intermittent or irregular one, and with the possibility (provision) for the guide (tension) roller to rotate only during one or some of the parts of the interval when it is embraced by the yarn. The rotation of the guide (tension) roller is intended to maintain constant tension in the yarn.

The principle of the device for carrying out the method according to the invention also can be that the delivery device of the yarn is made as a spinning-in head mounted on the attending device to be swingable through 90° and the spinning head carries guide roller for the yarn rotatably mounted on it. The circumference of the roller partly interferes with the yarn path between the bobbin and the detecting nozzle in the upper position of the spinning-in head.

DESCRIPTION OF THE DRAWINGS

An embodiment of a device for spinning-in yarn on an open-end spinning machine according to this invention is schematically shown in the accompanying drawings which show only mechanisms connected with the yarn spinning-in.

FIG. 15 is a view as in FIG. 14 in the phase prior to the yarn interruption for the spinning-in.

DESCRIPTION OF A PREFERRED EMBODIMENT

An open-end spinning machine includes a plurality of operating stations situated next to each other. Each operating station independently produces yarn from a sliver and winds the yarn thus produced on a bobbin that can be cylindrical or cone shaped, as needed.

Figure 1:
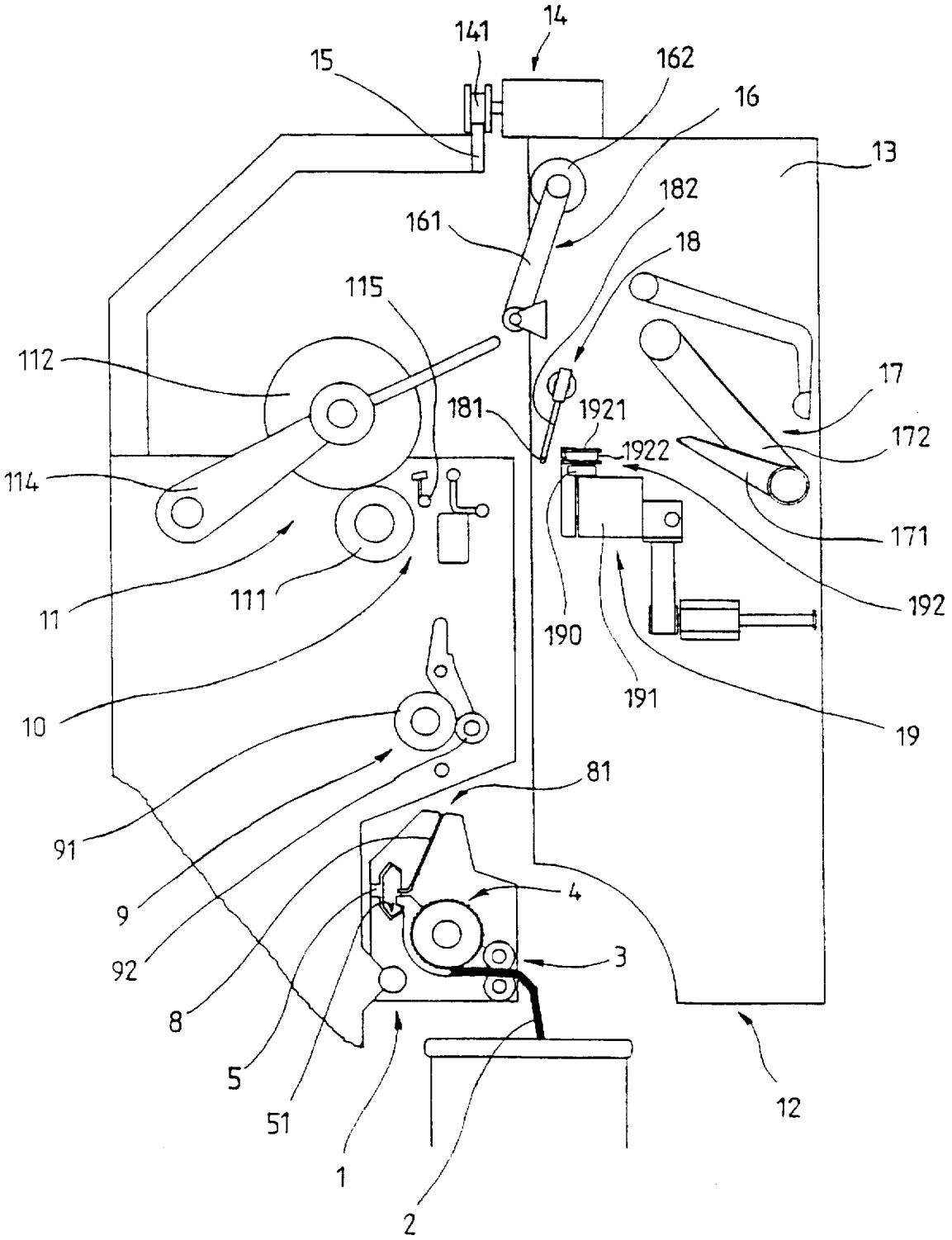
FIG. 1 is a side view of the mechanisms of one operating unit of an open-end spinning machine and also of an attending device in the rest position after the arrival of the attending device at that operating unit station.

FIG. 1 shows one of the plurality of operating stations. Each operating station comprises a spinning unit 1 into which a sliver 2 is led from a sliver can (not shown) by a sliver feeding device 3. The sliver 2 is taken from the feed device by a separating device 4 which separates the sliver into fibers. The fibers are fed in a known manner by means of underpressure into a spinning rotor 5. The underpressure in the spinning rotor 5 is generated either by the rotary motion of the spinning rotor 5, which is fitted on its circumference with air holes, or by placing a spinning rotor 5 made of full material into an underpressure chamber. Both of these methods of underpressure generation in the spinning rotor 5 are known, and the method of spinning-in yarn according to this invention can be applied with each of them. The separated (singled-out) fibers which are fed due to the underpressure into the spinning rotor are moved onto a collecting surface 51 of the spinning rotor 5 in a known manner due to the centrifugal force generated by the rotary motion of the rotor 5 where they produce a fiber band 6 that is transformed then in a known manner into yarn 7.

Figure 15:
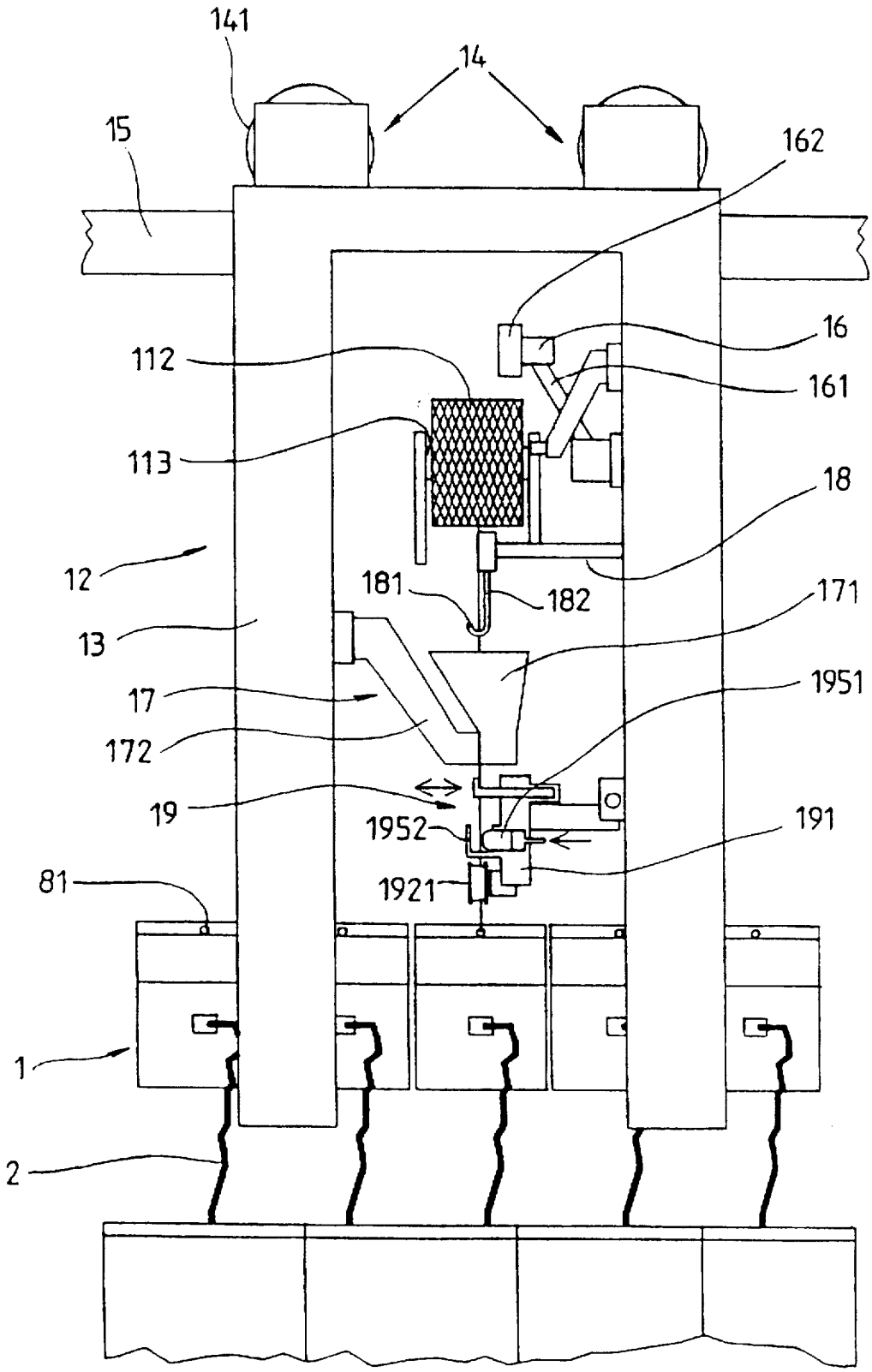

The spun-in yarn 7 is led from the spinning rotor 5 out through a delivery tube 8 and then towards a delivery device shown in the illustrated embodiment as a delivery roller 91 and that roller is common to the totality of the operating stations of each machine side. The roller 91 cooperates with a pressure roller 92 which is a part of each operating station and serves to press the yarn 7 onto the delivery roller 91. Following the delivery device 9, the yarn 7 passes via a known, not shown sensor of yarn rupture for monitoring the presence of the yarn 7. From the delivery device 9, the yarn 7 is led via a known, not shown sensor for yarn rupture and via a distributing device 10 made in one of several known ways, into a winding-up device 11. The winding-up device 11 contains a continuous drive roller 111 extending along the machine length. In a known manner, a bobbin 112 is positioned on the roller 111 and the bobbin is wound-on. The bobbin 112 has a tube 113 (FIG. 15), which is fixed in arms of a bobbin holder 114 which are in a known manner adapted both to be tilted away from the drive roller 111 of the winding-up device 11 so as to interrupt the winding upon the interruption of the spinning process, and are also adapted to be tilted away from each other to permit the wound bobbin 112 to be taken out, and the tube 113 to be inserted.

At the beginning of spinning after replacement of a full bobbin 112 with an empty tube 113 or after the rupture of the yarn 7, it is necessary to insert the end of the yarn 7, i.e., the end of the yarn that is extending from or toward the bobbin, into the spinning rotor 5 and to obtain connection of the yarn end with the fiber band 6 produced in a known manner in the spinning rotor 5 from the singled-out fibers. After connecting the end of the yarn 7 with the fiber band 6, i.e., after the spinning-in of the yarn end, drawing-off the spun-in yarn 7 from the spinning rotor 5 begins and the winding of the yarn 7 on the bobbin 112 is resumed. It is true that the spinning-in can be carried out manually as well. But the requirements of the spinning machine users on the quality of the connection of the yarn 7 with the fiber band 6, give preference to the application of an automatic attending device 12 assuming the function of the machine operator.

The attending device 12 is in a known manner adapted to move along the plurality of operating stations of the open end spinning machine, for instance, by being mounted on a rail path. The device 12 contains means for controlling the operating sections of the machine, by means of a control unit, not shown, which can be made a part of the attending device 12. In the description of this embodiment, only such parts of the attending device 12 are described that are active in the spinning-in process of the yarn 7, while other parts of the attending device 12 that have no direct relation to the goal of this invention will be omitted for the simplifying the description.

Figure 2:
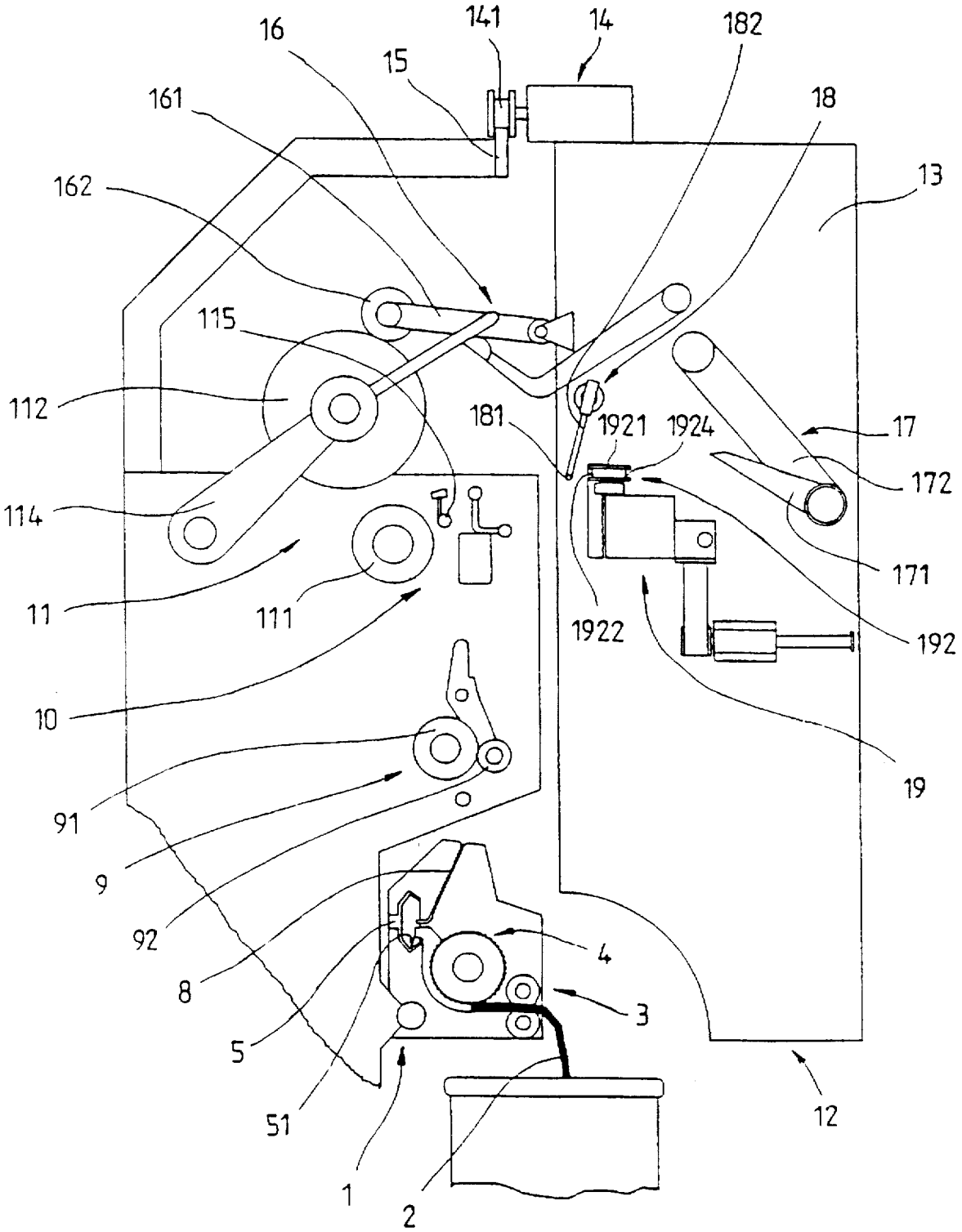
FIG. 2 is a view as in FIG. 1, but with the bobbin raised from its drive and a motion start device in an operating position.

If the spinning process is interrupted on an operating unit, either by a rupture of the yarn 7 being spun, or by the fact that the winding of the bobbin 112 has been completed upon either winding on a predetermined yarn length or upon reaching a predetermined diameter of the bobbin 112, i.e., when the wound bobbin 112 is to be replaced by a tube 113, the operating station awaits the attending device 12 to ensure the resumption of spinning. The bobbin 112 or the tube 113 is at that phase in its raised position out of contact with the drive roller 111 of the winding-up device 11 (FIG. 2).

The attending device 12 comprises a frame 13 having mounted thereon a travel device 14 fitted with travel wheels 141 that sit on a travel rail 15 that extends at least along the operating stations of one machine side. The travel device 14 permits the attending device 12 to move on the travel rail 14.

A motion-start device 16 for the bobbin 112 is situated on the frame 13 of the attending device 12. The device 16 comprises a swingably (rotatably) mounted arm 161 on which a drive roller 162 is rotatably mounted. That roller is coupled with a reversible drive (not shown) which, in turn, is coupled with a control unit (not shown). The arm 161 of the motion-start device 16 can swing between its rest position inside the frame 13 of the attending device (FIG. 1), and its operating position in which the drive roller 162 is in contact with the circumference of the raised bobbin 112 or of the raised tube 113 (FIG. 2).

Figure 3:
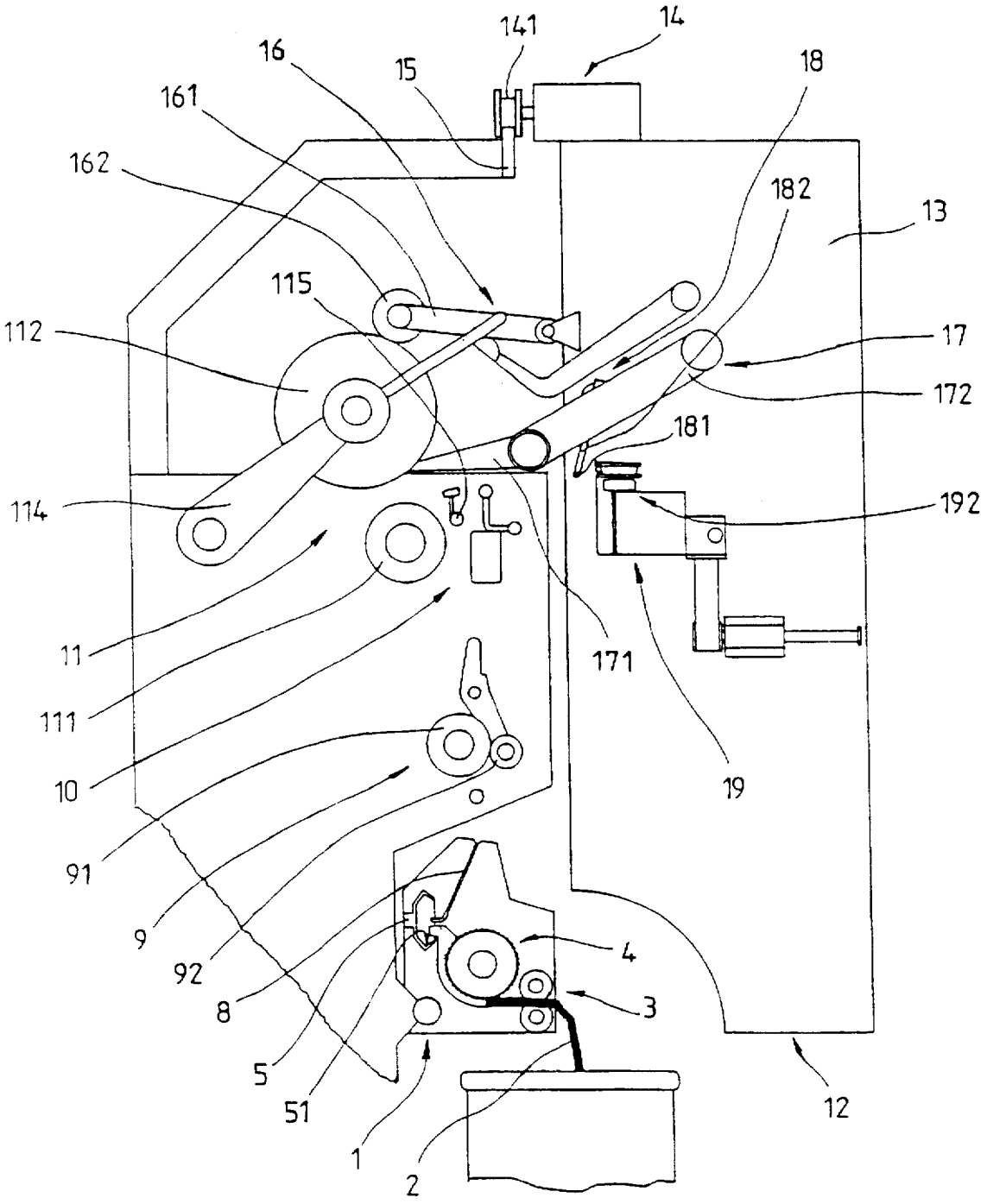
FIG. 3 is a view as in FIG. 1 in the phase of the yarn detection process on the bobbin.

The frame 13 of the attending device 12 also carries a detecting device 17 of the yarn 7 on the bobbin 112 comprising a detecting nozzle 171 coupled in a known way with an underpressure source (not shown). In this embodiment, the detecting nozzle 171 is seated on a hollow arm 172 of the detecting device 17. The hollow arm 172 is rotatably mounted on the frame 13 of the attending device 12, is coupled with a known drive (not shown), and is adapted to swing from its rest position in which it is situated inside the area of the frame 13 of the attending device 12 (FIG. 1), on one rotation side, into the detecting position of the yarn 7 (end) on the bobbin 112 (FIG. 3) in which it either lies near the bobbin 112 or is in contact with the surface of the bobbin and, on the other rotation side, into a handing-over position in which its distance from the bobbin 112 is greatest. The detected yarn 7 (end) is led from the bobbin 112 into the detecting nozzle 171. The detecting nozzle 171 can either be fixed (stationary) on the hollow arm 172 or, as illustrated, be rotatably mounted on the hollow arm 172, and can be coupled with a known drive (not shown), for instance with a step-by-step electric motor or with an air cylinder.

There is a yarn reserve building mechanism 18 on the frame 13 of the attending device 12 which comprises a catching hook 181 for catching the yarn 7 which is arranged adjustably so as to reach into the path of the yarn 7 between the bobbin 112 and the detecting nozzle 171 situated in its handing-over position of FIGS. 1 and 2. The catching hook 181 is mounted on a catching tie rod 182 which is seated on the frame 13 of the attending device 12. The rod 182 is both rotatable and swingable on the frame 13 and is coupled with drive means (not shown) for controlling such movements, e.g., with air cylinders or with step-by-step electric motors.

The frame 13 of the attending device 12 also carries a spinning-in head 19 having a body 191 on the frame 13 of the attending device 12. The body 191 is mounted swingingly like a crank arm and is coupled with a known drive (not shown), for instance with a step-by-step electric motor, an air cylinder or another air drive which actuates the swinging movement of the body 191 of the spinning-in head 19 between its rest position (FIG. 1) in which the body 191 of the spinning-in head 19 lies nearest (opposite) the winding device 11, the spinning-in head 19 being ready to take over the yarn 7, and the spinning-in position (FIG. 9) in which the body 191 of the spinning-in head 19 is situated over the spinning unit 1, the spinning unit 1 being ready to carry out spinning-in operations.

A guide roller 192 for the yarn 7 is rotatably mounted on the body 191 of the spinning-in head 19. The guide roller 192 of the yarn 7 is coupled with a known drive means (not shown), such as an electric motor or an air drive means, to ensure its rotating motion at least in the direction (sense) of unwinding of the yarn 7 from the bobbin 112. The drive means are seated inside the body 191 of the spinning-in head 19. In this embodiment, a conical guide surface 1922 provided on the circumference of the guide roller 192 for the yarn 7 narrows in the direction from the face 1921 of the guide roller 192 and passes in its narrowest section into a guide flange 1923. There is a guide groove 1924 between the flange 1923 and the guide surface 1922 to increase the friction between the yarn 7 and the guide roller 192 and to exactly define the position of the yarn 7 in all operations in which the yarn 7 wraps the circumference of the guide roller 192. The guide groove 1924 of the guide roller 192 can also be made in a different way, for instance with two conical surfaces chamfered to each other, etc.

Figure 6:
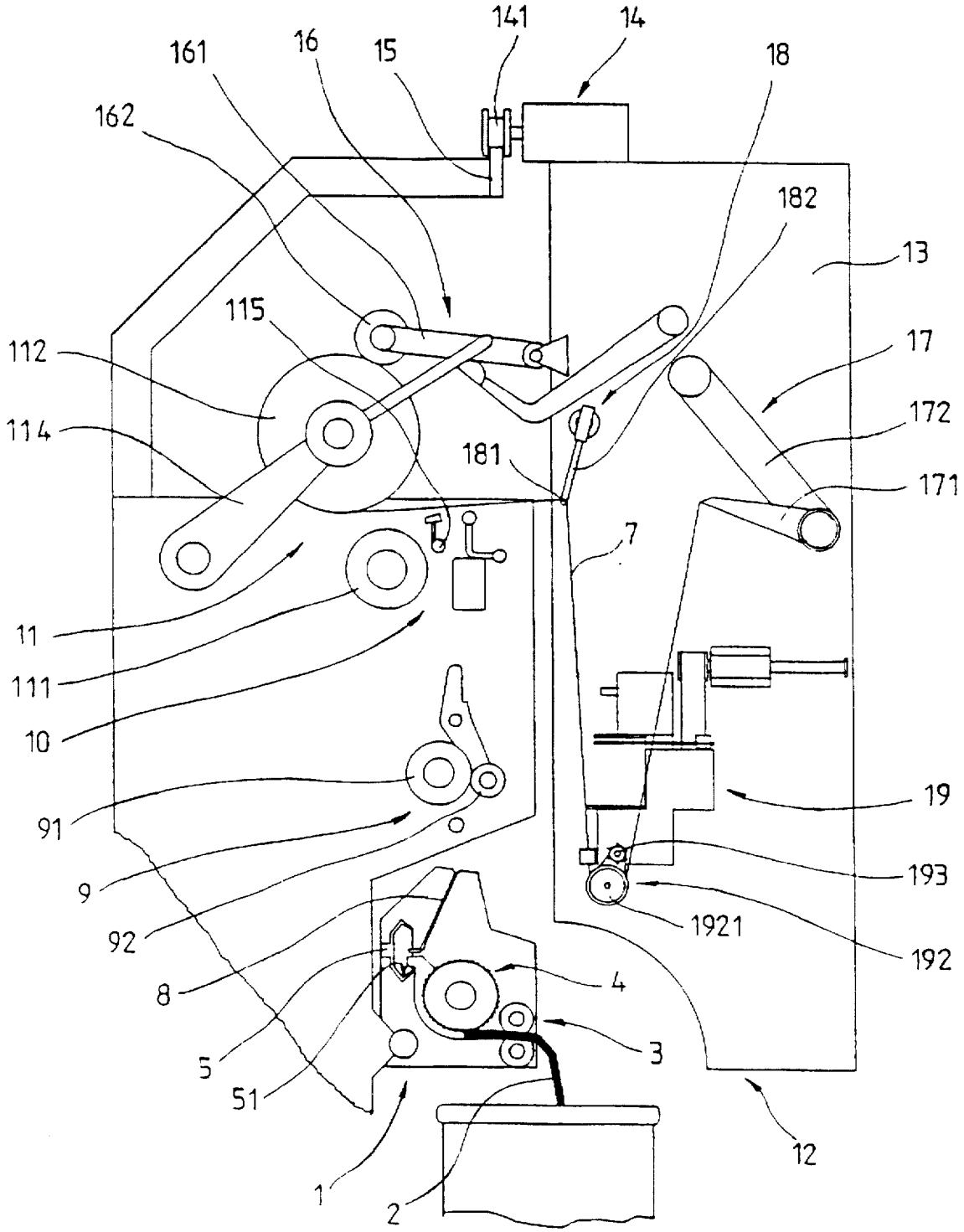
FIG. 6 is a view as in FIG. 1 in the phase of tilting of the spinning-in head.

A yarn trimming device 193 is also mounted on the spinning-in head 19. It contains, for instance, a known milling cutter 1931 which is coupled with a known drive, not shown (See FIGS. 6 and 10). At least during the time interval provided for yarn trimming, the milling cutter 1931 is situated in, or is movable into, the path of the yarn 7.

In this embodiment, the guide roller 192 of the yarn 7 is seated on an ancillary body 190 which, in turn, is seated in the body 191 of the spinning-in head 19. The body 190 is rotatable around an axis that coincides with the axis of revolution of the milling cutter 1931 of the yarn trimming device 193. In this embodiment, the drive means can be common to the ancillary body 190, the milling cutter 1931, and the guide roller 192, and can be seated on the body 191 of the spinning-in head 19. The driven members are connected to the drive means by transmissions, or the ancillary body 190, the milling cutter 1931, and the guide roller 192 can have each its separate drive means.

In another embodiment, not shown, the milling cutter 1931 of the yarn trimming device 193 is mounted only rotatably adjustably with respect to the body 191 of the spinning-in head 19 while the guide roller 192 is mounted on the body 191 of the spinning-in head 19. In still another possible embodiment, both the milling cutter 1931 of the yarn trimming device 193 and the guide roller 192 are arranged adjustably with respect to the body 191 of the spinning-in head 19.

In another embodiment, the ancillary body 190 is arranged adjustable, for instance by sliding, in the body 191 of the spinning-in head 19. The ancillary body 190 is coupled with a known drive, not shown, comprising, for instance, an electric motor or air cylinder, which is situated in the body 191 of the spinning-in head and provides for sliding movement of the ancillary body 190. Besides, the guide roller 192 of the yarn 7 is coupled with a drive, not shown, which imparts its rotary motion. In this case, the drive of the guide roller 192 is seated on the ancillary body 190. In this embodiment, the milling cutter 1931 of the yarn trimming device 193 is rotatably mounted in the body 191 of the spinning-in head 19.

An ancillary compensator 194 is seated on the body 191 of the spinning-in head 19 (FIG. 10) in this embodiment. It is a mechanical compensator comprising a rotatably supported compensation arm 1941 with a means for catching the yarn 7 fitted on its free end. The compensation arm 1941 is coupled with an extension spring 1942 that turns the compensation arm 1941 in a first counterclockwise direction while taking over the reserve of the yarn 7 released by the reverse motion of the catching tie rod 182. The compensation arm 1941 is also coupled with a drive (not shown) for causing reverse, clockwise turning motion of the compensation arm 1941 in subsequent operations in which the reserve of the yarn 7 is being used up. The compensation arm 1941 is coupled with the extension spring 1942 that acts in the first direction of turning of the compensation arm 1941 and that serves to support the stretching of the yarn 7. The drive of the compensation arm 1941 can, for instance, be an electric motor or an air cylinder.

Figure 16:
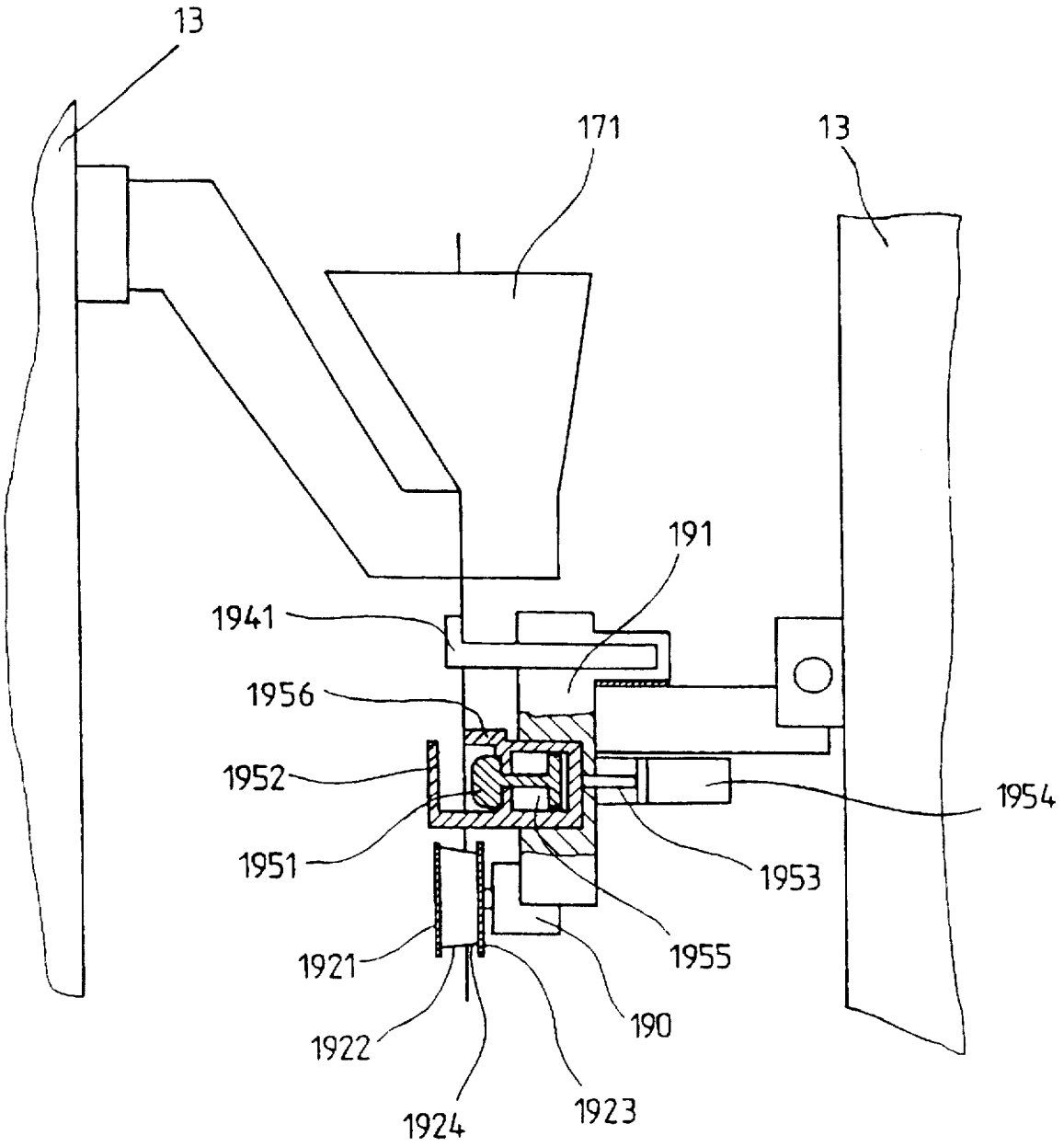
FIG. 16 is a detail of the spinning-in head with a spinning-in clamp and with a guide roller.

Also mounted on the body 191 of the spinning-in head 19 is a spinning-in clamp 195 (FIGS. 10, 15, 16) of the yarn 7 comprising an inner jaw 1951 and an outer jaw 1952 which are in the body 191 of the spinning-in head 19 and are seated adjustably with respect to each other as well as with respect to the body 191 of the spinning-in head 19. The mutually opposing surfaces of the inner jaw 1951 and of the outer jaw 1952 are adapted to grip the yarn 7. Both jaws 1951, 1952 of the spinning-in clamp 195 of the yarn 7 are coupled with a known drive (not shown) providing for their common motion with respect to the body 191 of the spinning-in head 19 and also providing for separate motion of at least one of the jaws 1951 or 1952 in the direction of, i.e., towards, the other jaw 1952 or 1951 for gripping the yarn 7. A holding arm 1956 for the yarn 7 (FIG. 16) is mounted on the body 191 of the spinning-in head 19 near the spinning-in clamp 195.

In the embodiment shown, the spinning-in clamp 195 includes the inner jaw 1951, which is mounted in the body 191 of the spinning-in head 19 on sliding pins 1953 and is coupled with a displacing air cylinder 1954 that slides it with respect to the body 191 of the spinning in head 19. The outer jaw 1952, which is coupled with a clamping air cylinder 1955, is adjustably mounted in the spinning-in clamp 195. In another embodiment, not shown, the above air cylinders 1954 and 1955 can be replaced by electric motors. In such an embodiment, the yarn holding arm 1956 is made as a fixed part of the spinning-in clamp 195 and is situated, in the direction of motion of the yarn 7, in front of the jaws 1951 and 1952 of the spinning-in clamp 195 of the yarn 7. In another embodiment, not shown, the holding arm 1956 of the yarn 7 can be made directly as the inner jaw 1951 of the spinning-in clamp 195 of the yarn 7.

All of the above mentioned drives, whether in the forms of electric motors, air cylinders, or other known means, are coupled with the control unit of the attending device 12 which especially controls and coordinates their functions.

Upon a rupture of the yarn 7 or when a required length of the yarn 7 has been wound on the bobbin 112, the feeding device 3 of the sliver 2 is stopped in a known manner. The bobbin 112, which was being wound, gets out of contact with the drive roller 111 and is stopped as well. After the attending device 12 arrives at the operating station where yarn spinning has stopped, it is first determined which operational cycle of the attending device 12 shall be chosen, i.e., whether the replacement of the (fully) wound bobbin 112 by an empty tube 113, followed by subsequent resumption of the spinning process and winding of the yarn 7 on the empty tube 113, or the resumption of operation of the operating station in question after a yarn rupture, i.e., resumption of winding on the bobbin 112. The state of things can be detected for instance by the arm 161 of the motion-start device 16. If the arm 161 of the motion-start device 16, while moving towards the bobbin 112, finds neither the bobbin 112 nor the empty tube 113, the operation of the attending device 12 switches over to spinning-in after the doffing of the bobbin 112 which is not an object of this invention. If the arm 161, while moving towards the bobbin 112, comes to lie onto the bobbin 112 or onto the tube 113, the cycle of spinning-in after a yarn rupture is activated which is the object of this invention. At least some items of the above information can be given from the operating station of the machine to the attending device in a known manner.

For resuming the spinning process on an operating station after a yarn rupture, first the bobbin is raised off the drive 111 and the motion start device 16 of the bobbin 112 is operated. Its arm 161 swings towards the machine so as to bring the drive roller 162 of the arm 161 into contact with the circumference of the bobbin 112 (FIG. 2). Simultaneously or afterwards, the detecting nozzle 171 of the detecting device 17 is moved into the detecting (searching) position (FIG. 3) in which the inlet aperture of the detecting nozzle 171 extends along the whole width of the winding of the bobbin 112 and is in a known manner connected to an underpressure source, not shown. The drive roller 162 is set in motion in the unwinding direction (sense) thus imparting rotary motion in the unwinding direction to the bobbin 112. The unwinding end of the yarn 7 from the bobbin 112 is sucked by underpressure into the detecting nozzle 171, irrespective of whether that end of the yarn 7, while it is being searched for, is situated in the central part of the winding of the bobbin 112 or near one of the lateral end faces of the bobbin 112. If the search for the end of the yarn 7 on the bobbin 112 has failed to find yarn, the attending device 12 qualifies the spinning unit 1 as is unattendable in a known way, its mechanisms resume their travel positions, and the attending device 12 moves to another spinning unit 1 then in need of attendance. The attending device 12 also can be arranged to repeat the search for the end of the yarn 7 on the bobbin 112 by means of the detecting nozzle 171 for a number of times and to qualify the spinning unit in question as unattendable only after the final attempt has failed.

If the search for the end of the yarn 7 on the bobbin 112 has been successful, the yarn 7 is sucked by the underpressure existing in the detecting nozzle 171 as far as into the hollow arm 172 where it passes over (across) the centering edge 173 provided inside the detecting nozzle 171 opposite the center of the inlet aperture of the detecting nozzle 171. Due to this edge, the yarn 7 stretched between the bobbin 112 and the detecting nozzle 171 is always situated in the central part of the inlet aperture of the detecting nozzle extending along the whole width of the winding of the bobbin 112. The position of the yarn 7 results from the centering edge 173 in connection with the point on the circumference of the bobbin 112 at which it is just being unwound. Following this, the hollow arm 172 of the detecting device 17 starts turning counterclockwise to its rear position in which it is shown in FIGS. 4 to 9. During the turning of the hollow arm 172 to the rear position, the bobbin 112 is turning in the unwinding direction, while the underpressure still existing in the detecting nozzle 171 holds the end of the yarn 7 in the detecting nozzle 171. In this embodiment, the position of the detecting nozzle 171 with respect to the hollow arm 172 does not change and remains the same as in the detecting position. In case it is needed, however, it would be possible to change this position. Inside the detecting nozzle 171, the yarn 7 invariably passes across the centering edge 173 of the detecting nozzle 171 prior to passing into the hollow arm 171.

Figure 4:
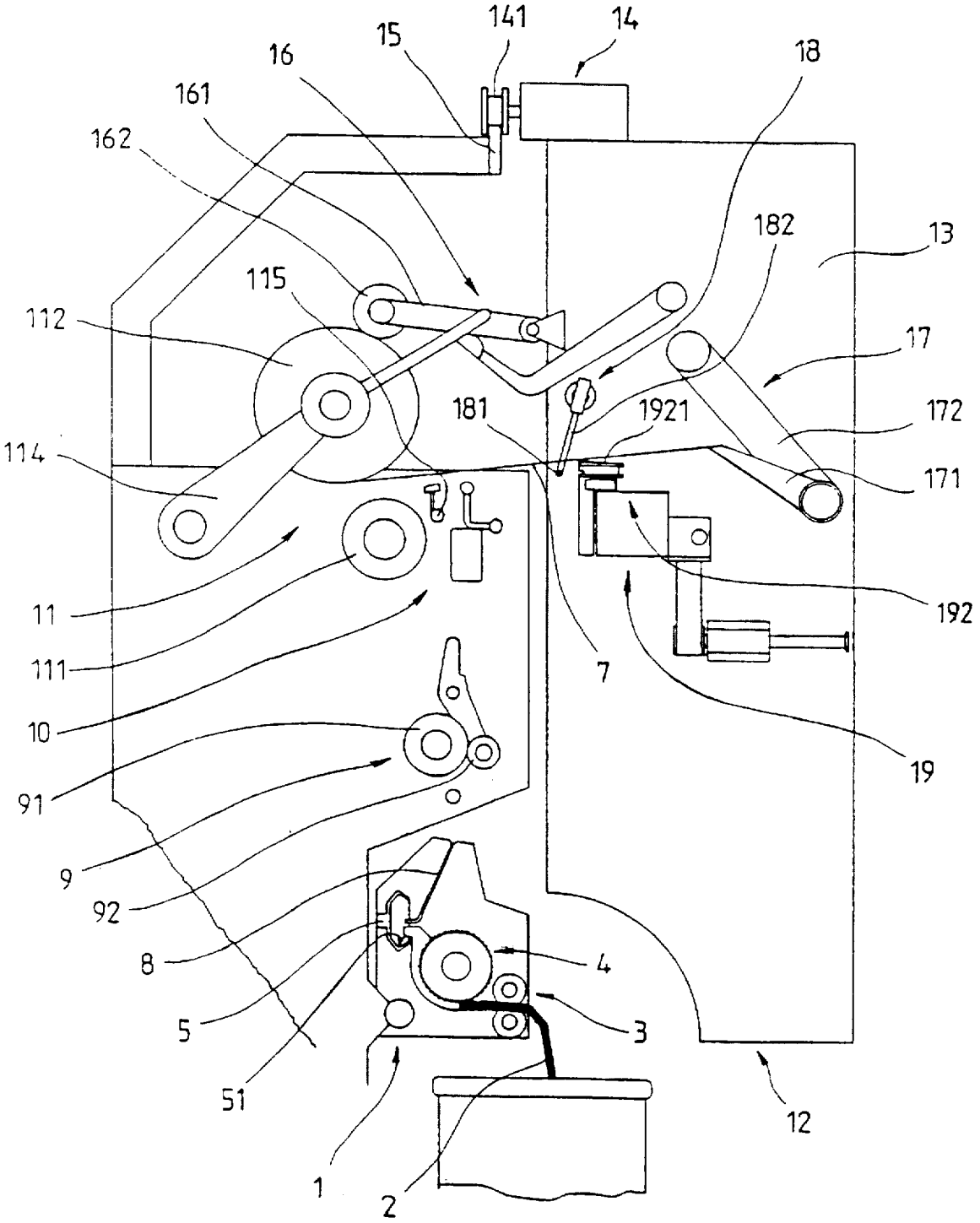
FIG. 4 is a view as in FIG. 1 in the phase when the yarn has been caught by the detecting device and after the detecting nozzle has moved to its rear position.

After, or even before, the hollow arm 172 of the detecting device 17 has reached its rear position, the yarn reserve building device 18 is set in action. It slides out of the side wall of the attending device 12. It has a catching tie rod 182 which ends in a catching hook 181 which in this embodiment obliquely swings so that the section containing the catching hook 182 is swung away from the side wall of the attending device 12. During the sliding-out motion of the yarn reserve building device 18, the catching tie rod 182 passes across the path of the yarn 7 which is stretched between the bobbin 112 and the detecting nozzle 171 (FIG. 4). The yarn reserve building device slides out as far as its end position in which the position of its tie rod 182 coincides with the path of the yarn stretched between the centering edge 173 of the detecting nozzle 171 and the border of the bobbin 112 that is more distant from the side wall of the attending device 12 on which the yarn reserve building device 18 is mounted. Consequently, the yarn 7 comes into contact with the tie rod 182 whenever the yarn reserve building mechanism 18 has slid out.

Figure 5:
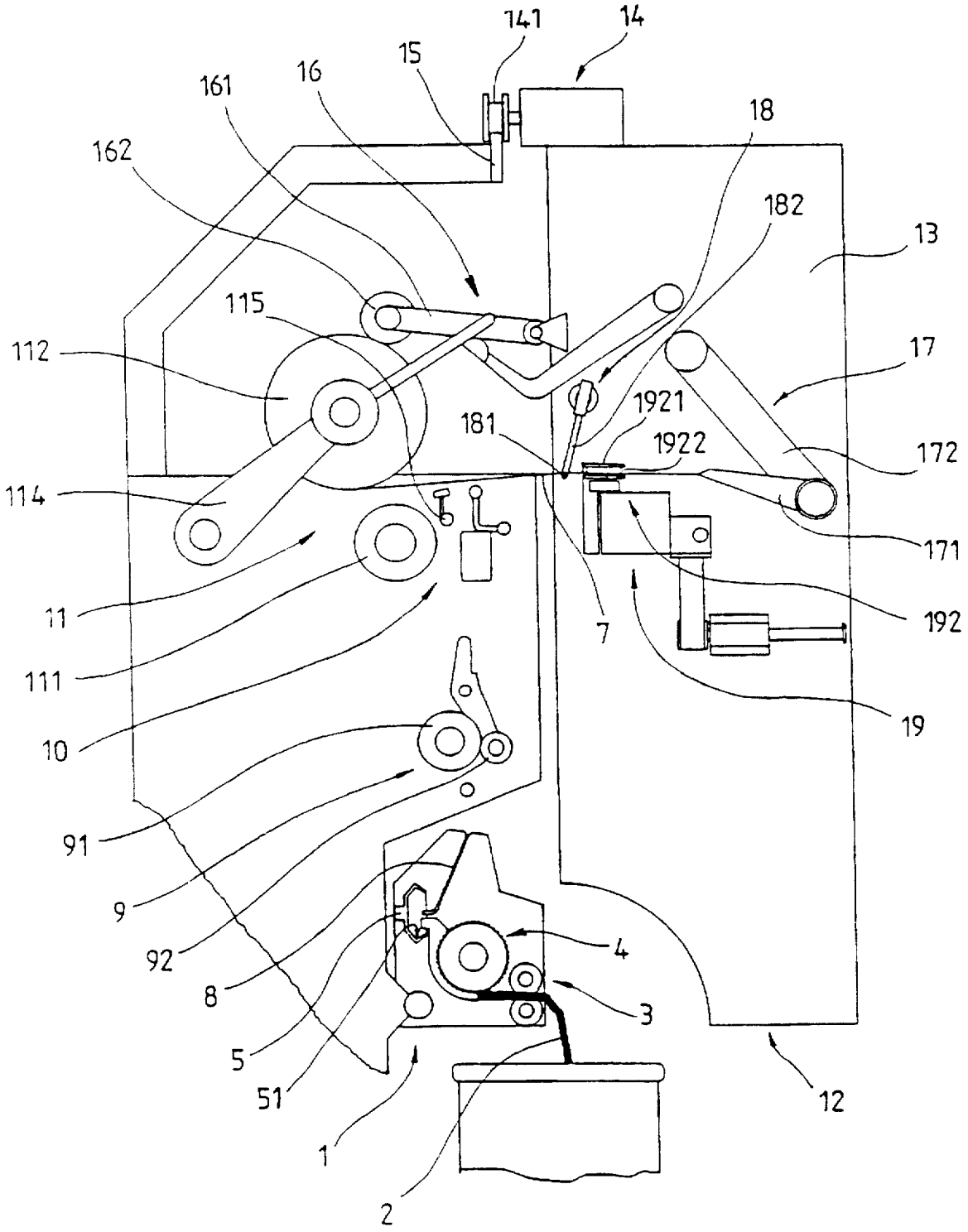
FIG. 5 is a view as in view as in FIG. 1 in the phase of catching the yarn by the yarn length metering device and yarn insertion into a guide roller of a spinning-in head.

When the yarn reserve building device 18 has reached its end slid-out position, the detecting nozzle 171 on the hollow arm 172 of the detecting device 17 tilts down so as to transfer the yarn 7 stretched between the bobbin 112 and the detecting nozzle 171 downwards along the catching tie rod 182 and catch it in the catching hook 181 (FIG. 5). In this phase, the catching tie rod still occupies the above mentioned obliquely swung position.

After the yarn 7 is caught in the catching hook 181 of the yarn reserve building device 18, the catching tie rod 182 with the catching hook 181 tilts towards the side wall of the attending device on which the yarn reserve building device is seated so as to reach its handing-over position in which the catching tie rod 182 lies in a vertical plane perpendicular to the longitudinal axis plane of the machine. After the catching tie rod 182 has been tilted to its handing-over position, the yarn 7, stretched by the underpressure in the detecting nozzle 171 between the bobbin 112 and the centering edge 173 of the detecting nozzle 171, is deflected by the catching hook 181 from its direct path and embraces the conical guide surface 1922 of the guide roller 192 of the spinning-in head 19. Besides, it is pressed onto the guide flange 1923 of the guide roller 192 due to the tilted position of the detecting nozzle 171 (FIG. 5).

The position of the catching rod 182, while being slid out for catching the yarn 7 stretched between the bobbin 112 and the centering edge 173 of the detecting nozzle 172, can be varied and in relation to this position, also varies the length of the sliding-out motion so as to ensure that the yarn 7 will be reliably caught by the catching tie rod 182. The position of the catching tie rod during the tilting of the detecting nozzle 172 must be chosen to ensure uninterrupted contact of the yarn 7 with the catching tie rod required for fully reliably catching the yarn 7 in the catching hook 181 even after the detecting nozzle 172 has been tilted.

The spinning-in head 19 then tilts over the spinning unit 1 an angle of 90° from its position in FIG. 5 with the roller 192 horizontal to its spinning-in position shown in FIGS. 6 to 13 with its roller 192 vertical. In and after this tilting phase, the yarn 7 still remains caught on the body 191 and still embraces its guide groove 1924. During this operation as well as during the preceding ones of the spinning-in yarn reserve building, the bobbin 112 turns in the unwinding direction because an increasing length of yarn is required. During the revolving movement of the spinning-in head 19, the body 191 can turn in the direction (sense) of unwinding of the yarn 7 from the bobbin 112, thus contributing to the yarn reserve building and reducing the risk of the stoppage or rupture of the yarn 7 between the bobbin 112 and the detecting nozzle 171. When the spinning-in head 19 has reached its spinning-in position (FIG. 6), the yarn 7 stretched between the bobbin 112 and the detecting nozzle 171 is led via the machine compensators 115 and the hook 181 and embraces the body 191 from which it is led into the detecting nozzle 171.

Figure 7:
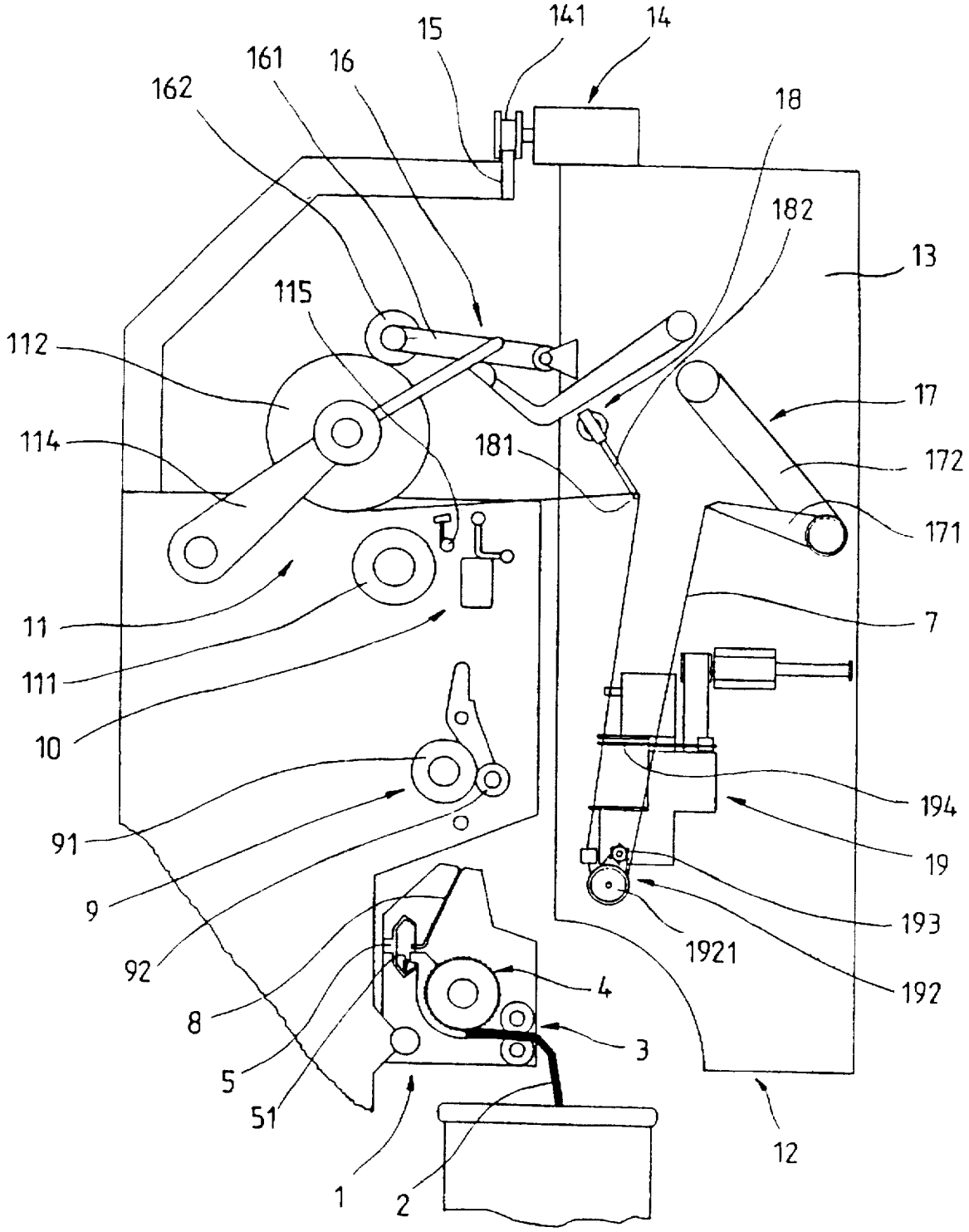
FIG. 7 is a view as in FIG. 1 in the phase of FIG. 6 in the phase of inserting the yarn into an ancillary compensator.
Figure 8:
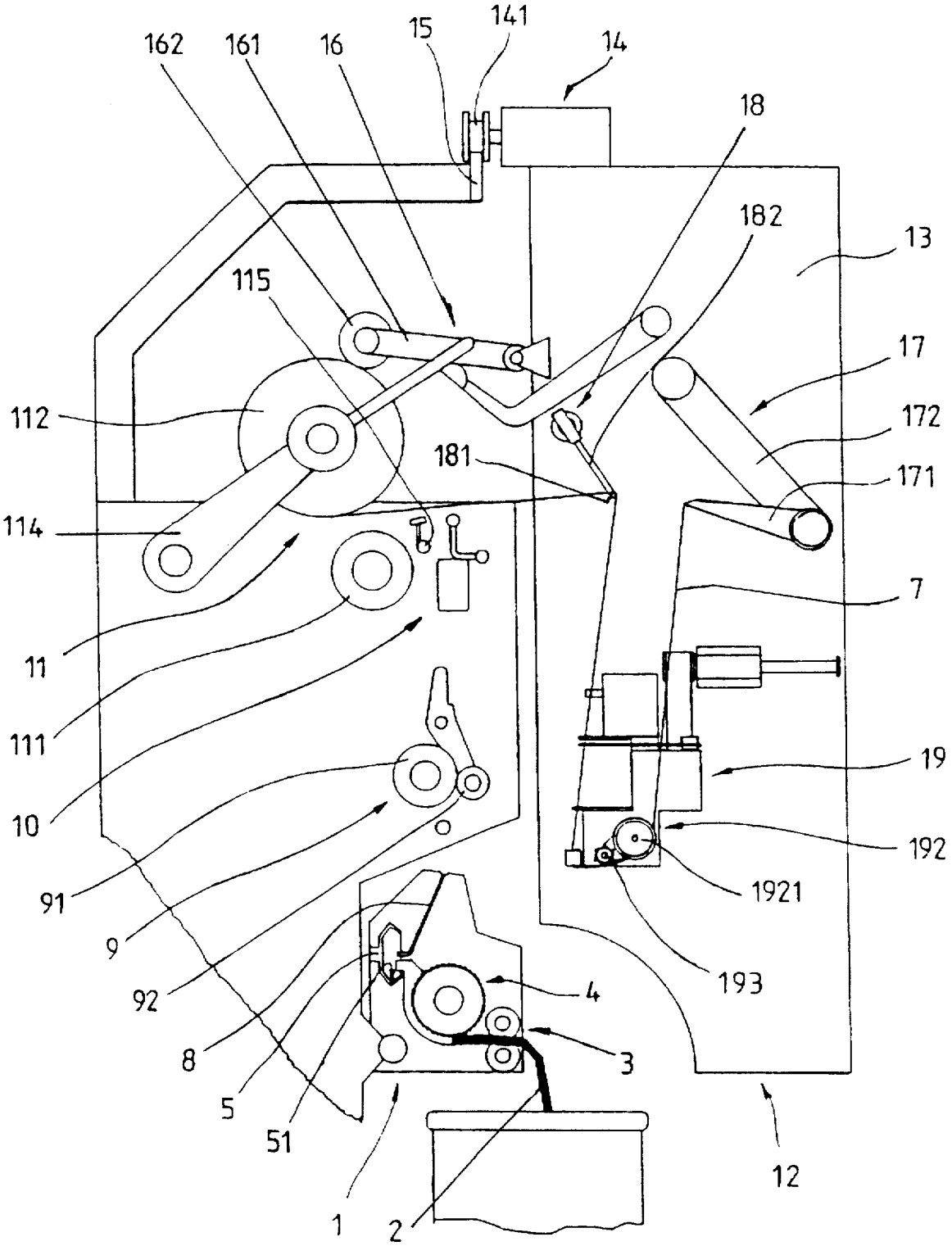
FIG. 8 is a view as in FIG. 1 in the phase of the yarn interruption process.

After, or even during, the tilting of the spinning-in head 19 to its spinning-in position, the yarn reserve building device 18 begins to turn the tie rod 182 counterclockwise to its rear position, with the yarn 7 still hanging on the hook 181 and the bobbin 112 turning in the unwinding direction of the yarn 7 (FIG. 7). When the rear position of the tie rod 182 has been reached, the length of the yarn reserve is metered and the drive roller 162 of the motion-start device 16 stops and thus brakes the bobbin 112.

Figure 10:
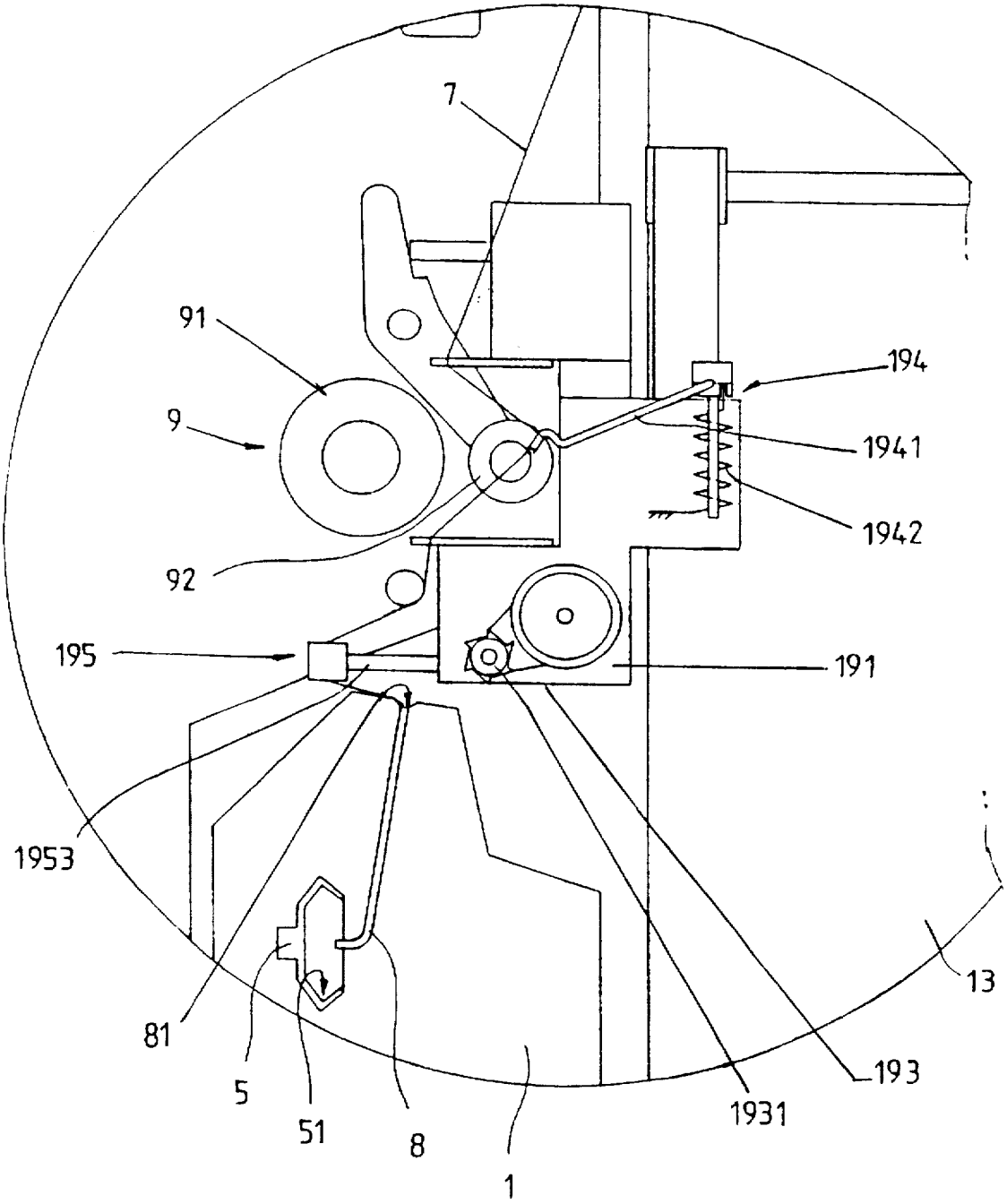
FIG. 10 is a detail of the spinning-in head of the attending device, of a draw-off device of the operating station of the machine, and of the spinning unit of the operating station of the machine in the phase of insertion of the spinning-in yarn end into the inlet aperture or the spinning unit.
Figure 11:
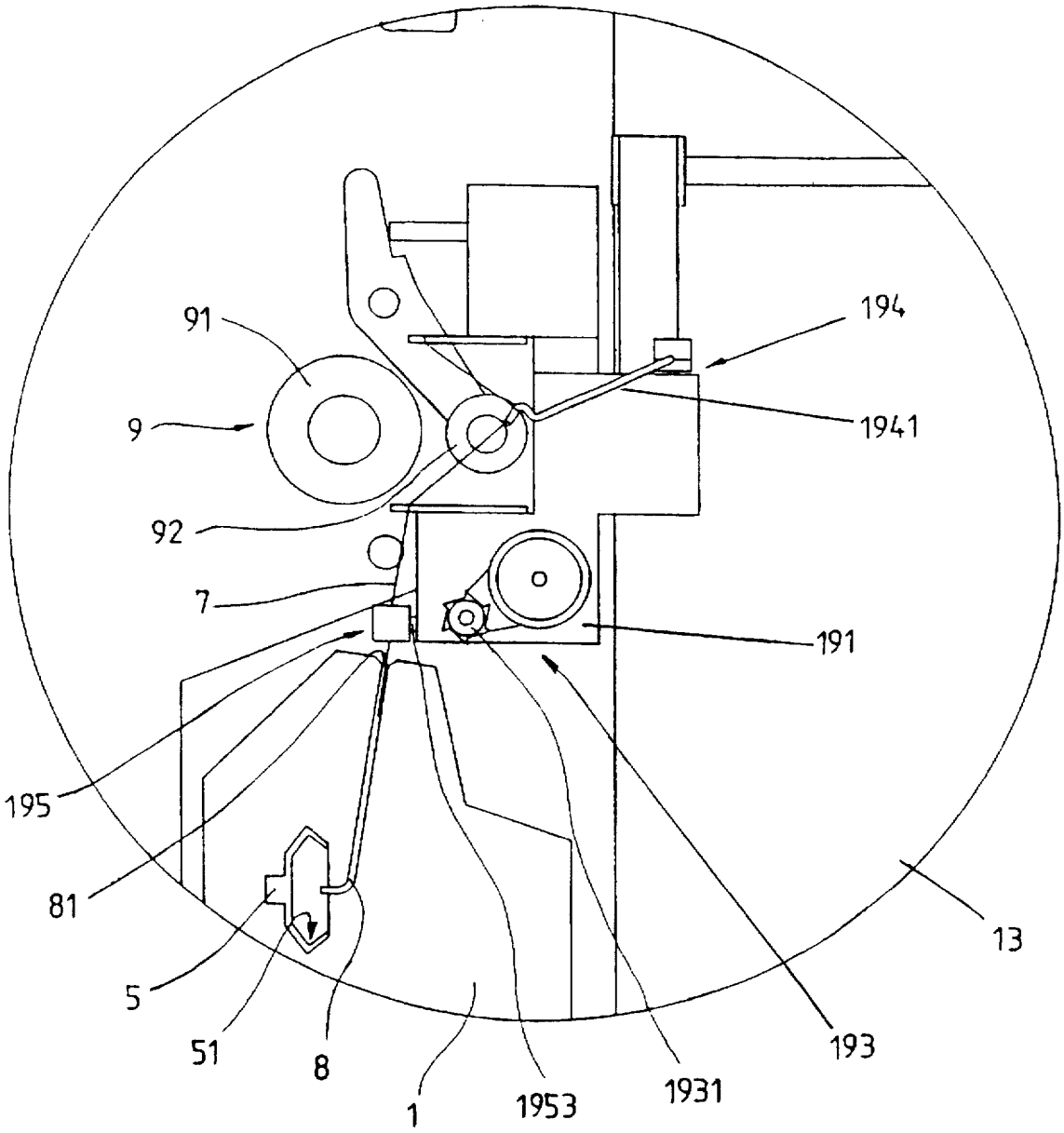
FIG. 11 is a detail as in FIG. 10 in the phase of the reverse motion of the compensation arm of the ancillary compensator.
Figure 12:
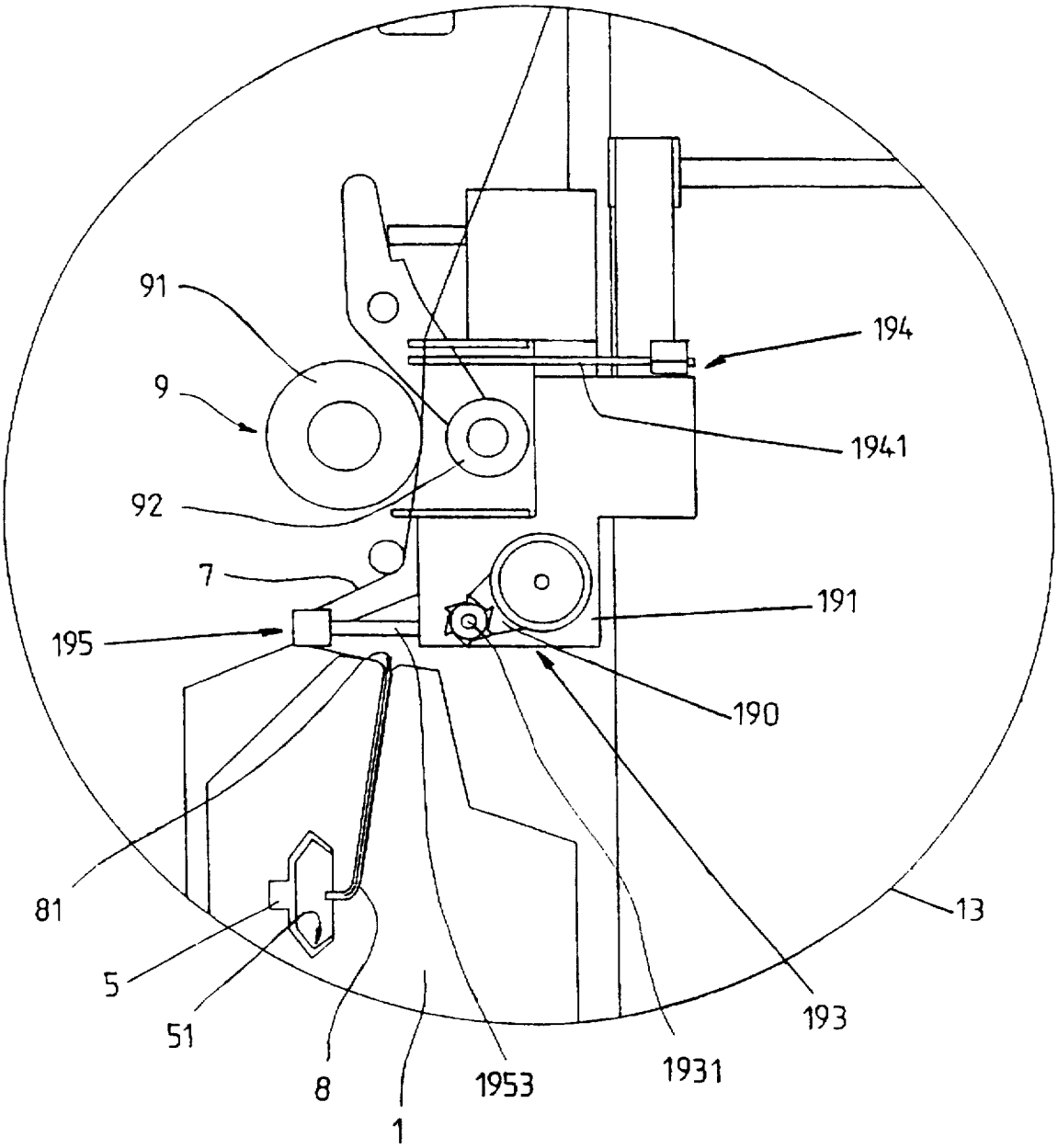
FIG. 12 is a detail as in FIG. 10 in the phase of the complete return of the compensation arm of the ancillary compensator and of the yarn insertion into the draw-off device.
Figure 13:
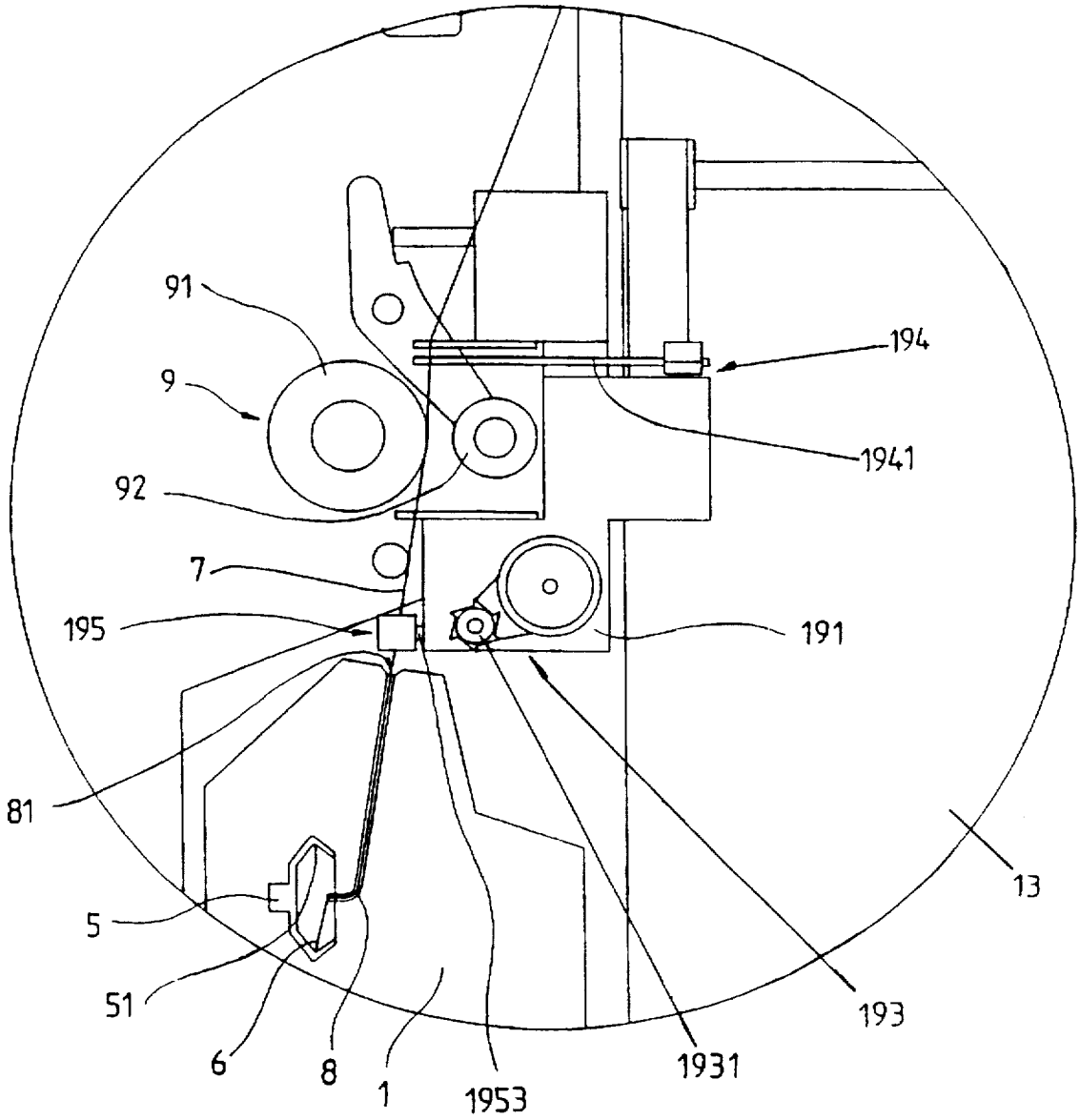
FIG. 13 is a detail as in FIG. 10 in the spinning-in phase, i.e., at the moment of the connection of the spinning-in yarn end with the fiber band in the spinning rotor.
Figure 14:
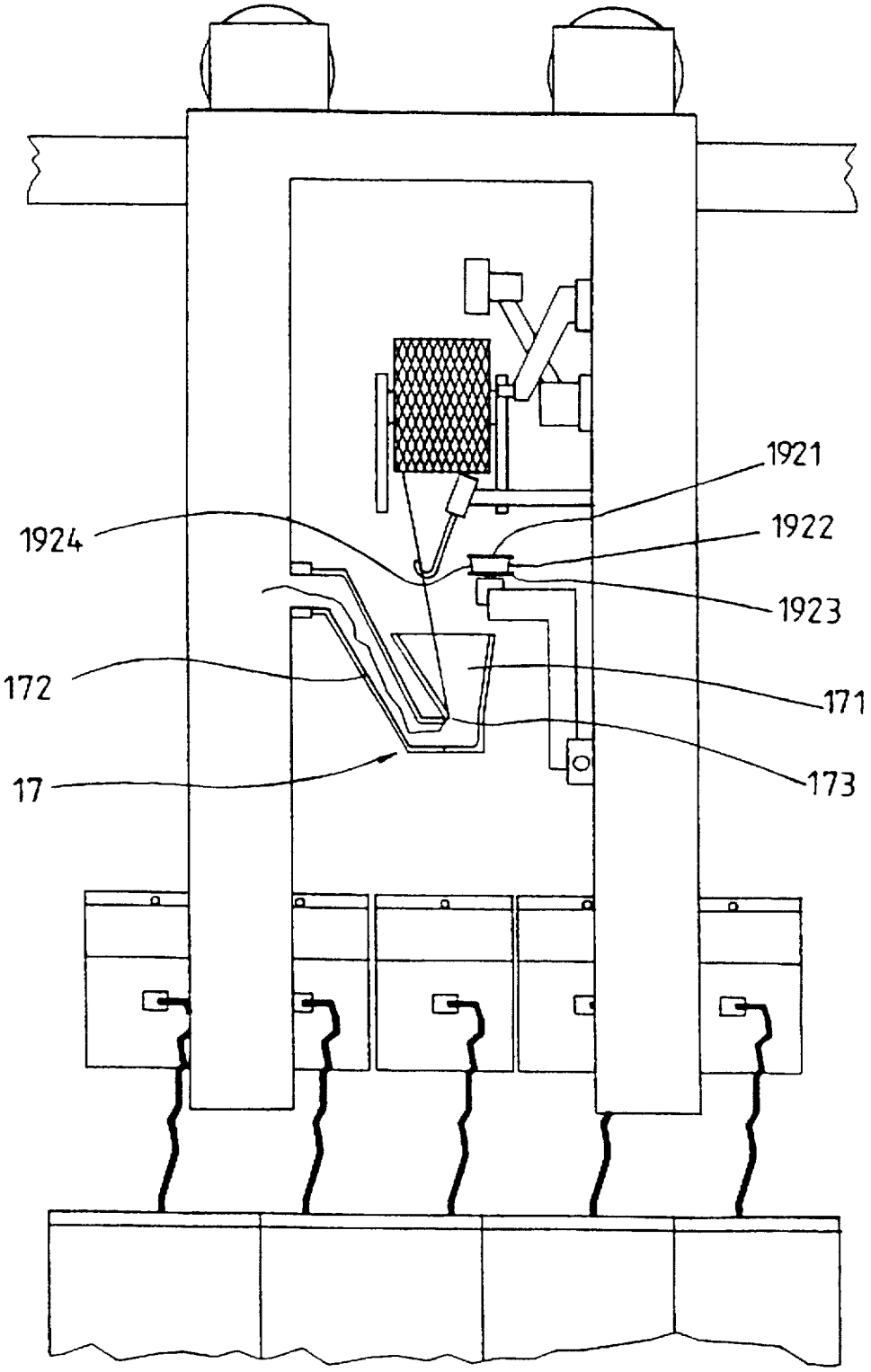
FIG. 14 in is a front view of the attending device when it is attending the operating station after having detected the yarn end in the phase of the yarn sucking into the detecting nozzle of the yarn detection device.

In the next phase, the ancillary compensator 194 of the spinning-in head 19 and its extension spring 1942 begin to act on the compensation arm 1941 with a stretching force in a first direction, to the right in FIG. 10. The catching tie rod 182 of the yarn reserve building device 18 begins then to return and the yarn 7 released by this catching tie rod 182 is taken over and stretched by the compensation arm 1941 of the ancillary compensator 194 (FIG. 10) up to the moment when the reverse motion of the catching tie rod 182 stops and the compensation arm 1941 of the ancillary compensator 194 reaches the maximum of its deflection. From that moment on, the built yarn reserve is transported to the area of the spinning-in head 19 and is ready to be spun-in.

In the next step, the yarn 7 between the ancillary compensator 194 and the guide roller 192 is inserted into the spinning-in clamp 195 of the yarn 7 where it is gripped between the inner jaw 1951 and the outer jaw 1952. The yarn 7 may be gripped in the spinning-in clamp 195 already at an earlier stage, but in every case only after the yarn reserve has been metered and the bobbin 112 braked.

After the yarn 7 has been clamped (gripped) in the spinning-in clamp 195, it is trimmed in a known way, for instance by means of the rotating milling cutter 1931 of the yarn trimming device 193 after a previous approach between the milling cutter 1931 and the yarn 7. The drive of the milling cutter 1931 acts. The ancillary body 190 becomes connected to that drive by transmissions, not shown, and is turned to its trimming position to which it carries also the guide roller 192, which is still wrapped by the yarn 7. During this movement, the path of the yarn 7 changes at the latest at the moment when the guide roller 192 has reached its trimming position so that the yarn contacts the circumference of the milling cutter 1931 and is trimmed at the contact point. The trimmed off front part of the yarn 7 is then sucked into the detecting nozzle 171. After being spun-in, the yarn 7 is led from the bobbin 112 via the machine compensators 115, the catching hook 181 of the yarn reserve building device 18, the delivery device 9, the sensor, not shown, of the presence of the yarn 7 that is being delivered and wound, and the ancillary compensator 194 into the spinning-in clamp 195 in which it is clamped (gripped). Under the jaws 1951 and 1952 of the spinning-in clamp 195 there is a free end 71 of the yarn 7.

Following this, the spinning-in clamp 195 moves (slides out) towards the machine (FIG. 9), the free end 71 of the yarn 7 beneath the clamp 195 arrives into the area of the underpressure action in the mouth of the delivery nozzle 8 of the spinning unit 1 and is sucked into the delivery nozzle 8.

The next step is to open both the inner jaw 1951 and the outer jaw 1952 to release the yarn 7 being then only led between said jaws 1951, 1952 and coming to lie on the holding arm 1956 of the yarn 7 in the section between the jaws 1951, 1952 and the ancillary compensator 194.

At this stage a drive, not shown, of the compensation arm 1941 of the ancillary compensator 194 begins to turn back and opposite the direction of action of the extension spring 1942 thus releasing the yarn 7 that was drawn (sucked) in by the delivery nozzle 8 in the direction towards the spinning rotor 5 of the spinning unit 1.

Preferably, the spinning-in clamp 195 is moved nearer towards the machine, as compared with the position of the delivery nozzle 8.

Figure 9:
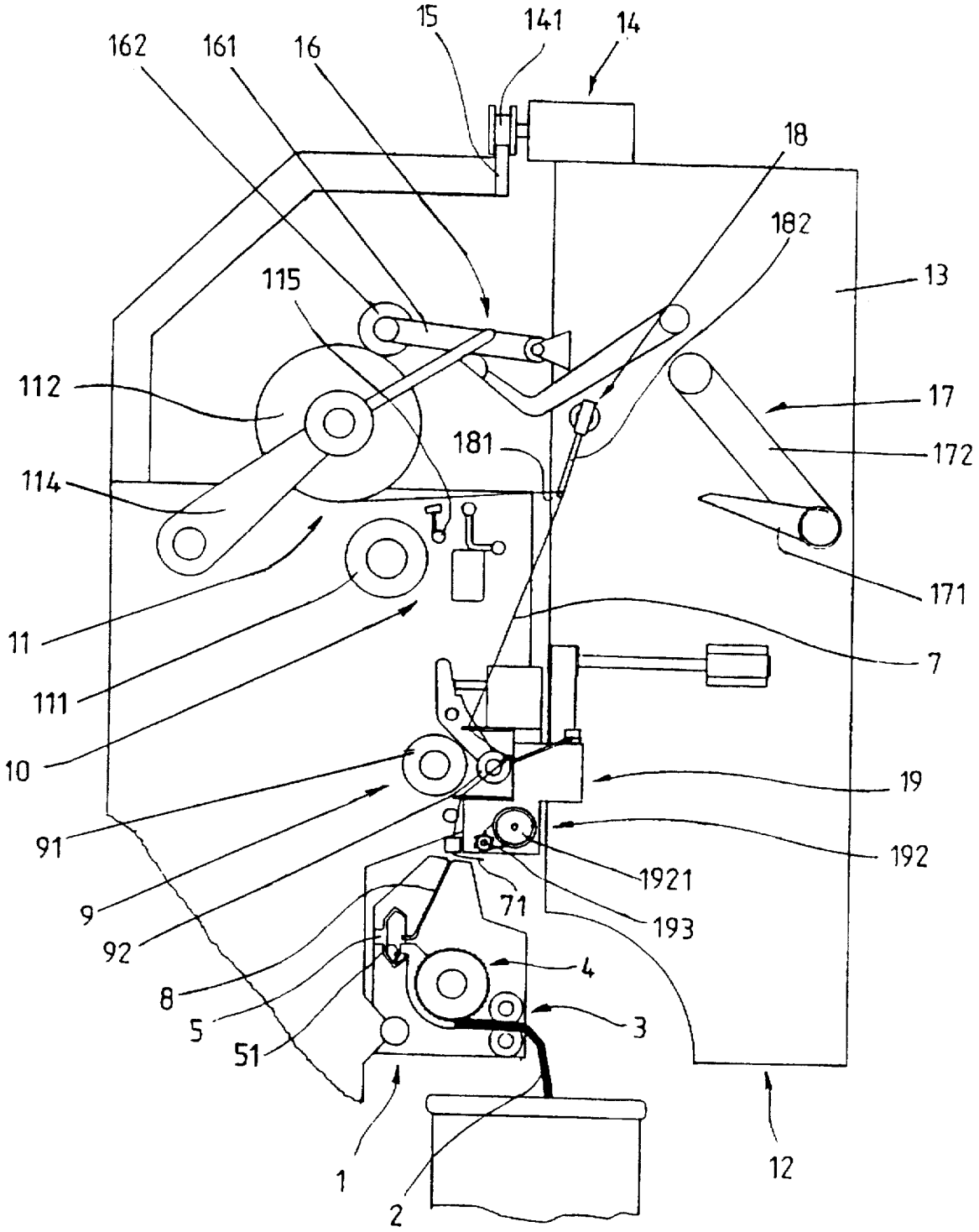
FIG. 9 is a view as in FIG. 1 in the phase after the yarn interruption.

After the free end 71 of the yarn 7 has been sucked into the delivery nozzle 8, the spinning-in clamp 195 can be partially moved back, i.e., in the direction away from the machine, thus permitting a longer section of the free end 71 of the yarn 7 to get into the delivery nozzle 8 prior to the opening of the jaws 1951, 1952. This eliminates the risk of the free end 71 of the yarn 7 falling out during subsequent operations. Before the complete return of the compensation arm 1941, the spinning-in clamp 195 moves (slides out) to its spinning-in position in which, after the complete return of the compensation arm 1941 of the ancillary compensator 194, the yarn 7 is led into the delivery nozzle 8 via the holding arm 1956 of the yarn 7. The free end 71 of the yarn 7 reaches as far as the spinning rotor 5 (FIG. 9).

The sinking of the free end 71 of the yarn 7 into the spinning rotor 5 so as to be amalgamated there with the fiber band 6, i.e., the spinning-in, is carried out at a known suitable moment by the reverse motion of the spinning-in clamp 195 of the yarn 7 with the holding arm 1956 of the yarn 7. After the spinning-in of the yarn 7, the delivery device 9 of the yarn 7 is set in motion and the spun yarn 7 is wound on the bobbin 112. In the first stage of the winding, the yarn 7 is located on the catching hook 181 of the yarn reserve building device 18. It is then released from the hook and handed over only to the mechanisms of the operating station of the machine.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of spinning-in yarn on an open end spinning machine following rupture of the yarn being spun, comprising the steps of:

detecting the end of the yarn on a bobbin on which the yarn is being wound;

sucking the end of the yarn off the bobbin and into a detecting nozzle;

unwinding yarn from the bobbin while moving the unwinding yarn generally toward a spinning unit including a spinning rotor which spins the yarn;

forming an end of the yarn that is being withdrawn from the bobbin and introducing the yarn end into a spinning rotor of the spinning unit and subsequently sinking the yarn end onto a collecting groove of the spinning rotor for joining the yarn end to the fibers produced in the collecting groove from a fiber band;

during the unwinding of the yarn from the bobbin, applying a force to the yarn between the bobbin and the detecting nozzle in the yarn unwinding direction by rotating a tension roller in the unwinding direction to impart tension to the yarn for achieving uniform yarn tension during the unwinding and during the transferring up to creation of the spinning-in yarn end; and transferring the yarn now being spun to a yarn distributing device for distributing the yarn along the bobbin for achieving a constant quality and size of the spinning-in junction points.

2. The method of claim 1, wherein the step of applying a force to the yarn comprises embracing the yarn on part of the circumference of a tension roller of a spinning-in head at least during part of the interval when the yarn is being unwound, for applying a mechanical force to the yarn; and after the yarn embraces the tension roller, swinging the tension roller through an angle for transferring the tension roller and yarn thereon from generally more toward the bobbin to a direction generally more toward the spinning unit.

3. The method of claim 2, wherein the tension roller is swung through an angle of 90°.

4. The method of claim 2, wherein the step of embracing the yarn on part of the circumference of the tension roller comprises catching the yarn on adjustable means located between the bobbin and the tension roller and passing the yarn freely through the adjustable means so that the yarn embraces around the circumference of the tension roller between the adjustable means and the nozzle; and after the swinging of the tension roller in the direction toward the spinning unit, metering the yarn length required for spinning-in and stopping the turning of the bobbin in the unwinding directions for fixing the metered yarn length required for spinning-in.

5. The method of claim 2, wherein during the unwinding of the yarn, the tension roller turns interruptedly and intermittently in the yarn unwinding direction.

6. The method of claim 2, wherein during the unwinding of the yarn required for resumption of the spinning, the tension roller turns in the yarn unwinding direction at least before the yarn end is formed.

7. The method of claim 2, wherein the tension roller is turnable at a variable speed.

8. The method of claim 2, further comprising metering the yarn length required for spinning-in and stopping the turning of the bobbin in the unwinding direction for fixing the metered yarn length required for spinning-in;

clamping the yarn in the direction of the yarn unwinding before the yarn reaches the tension roller and after the length of the yarn required for spinning-in has been metered, wherein the turning movement of the tension roller stretches the yarn both before and after the clamping;

forming the yarn end comprising trimming the yarn between the clamping point and the tension roller for creating a spinning-in yarn end in the mechanically stretched yarn section.

9. The method of claim 8, wherein after the yarn has been clamped, the adjustable means moves toward a handing over position for the yarn at which the yarn is released from the adjustable means in the location between where it is clamped and a delivery device past the rotor on the yarn path to the bobbin;

placing the yarn nearer to its regular spinning path in the machine by an ancillary compensator.

10. The method of claim 8, further comprising after forming the end of the spinning-in yarn, moving the clamped end region of the yarn into the area of action of underpressure in the outlet aperture of the delivery tube of the rotor; sucking the end of the yarn into the delivery tube, then opening the clamp and moving the clamp away to release the yarn, and releasing the yarn by the ancillary compensator to be sucked into the spinning rotor, whereby the yarn is nearing its operating path in the area of the delivery device, and partially inserting the end of the spinning-in yarn into the spinning rotor up to a predetermined distance from the collecting groove of the rotor.

11. The method of claim 10, further comprising moving the clamp for the yarn outside the regular spinning path of the yarn and quickly moving the ancillary compensator back outside the regular spinning path of the yarn for releasing the yarn to enable the yarn to enter its regular spinning path and to enable the spinning-in end of the yarn to sink onto the collecting groove of the rotor.

12. The method of claim 10, further comprising setting the clamp for the yarn to an ancillary deflecting position, and completing the reverse motion of the ancillary compensator outside the regular spinning path of the yarn for thereby orienting the yarn to its regular spinn in a path in the delivery device;

then moving the clamp outside the regular spinning path of the yarn for releasing the yarn to its regular spinning path between the outlet of the delivery tube of the rotor and the delivery device for then letting the spinning-in end of the yarn sink onto the collecting groove of the spinning rotor.

13. Apparatus for spinning-in yarn on an open end spinning machine following a yarn rupture wherein the apparatus includes an operating unit including a spinning rotor for producing yarn, a bobbin for receiving the yarn produced, means for supporting the bobbin for having yarn wound thereon and for rotating the bobbin;

a delivery device located between the rotor and the bobbin;

the apparatus further includes an attending device adapted to travel to the operating unit; the attending device comprising a yarn end detecting device on the attending device, the yarn end detecting device including a yarn end detecting nozzle adapted to be placed near the circumference of the bobbin for detecting a yarn end there;

a yarn transfer device on the attending device for bringing the yarn to the spinning rotor at the operating station;

means for enabling rotation of the bobbin in the unwinding direction and for applying tension to the yarn during the unwinding;

means for trimming an end of the yarn that is on the bobbin and which end is to be spun-in;

a yarn reserve building device for metering the length of yarn required for spinning-in, the metering device comprising a yarn catching rod adjustably mounted across the yarn path, disposed between the bobbin and the detecting nozzle and also movable in the plane perpendicular to the axis of rotation of the bobbin; and an ancillary compensator rotatably mounted to rotate in the plane perpendicular to the axis of rotation of the bobbin in a forward direction for deflecting the yarn and in a reverse direction for releasing the yarn.

14. The apparatus of claim 13, wherein the ancillary compensator includes a compensation arm swingably mounted on the attending device;

an extension spring connected with the arm for biasing the arm in the direction of yarn deflection;

a reverse drive for selectively acting on the compensation arm with a force greater than that of the extension spring and in the opposite direction.

15. The apparatus of claim 13, wherein there are a plurality of the operating units along the machine, and the attending device is selectively movable to any one of the operating units for acting on the operating unit.

16. Apparatus for spinning-in yarn on an open end spinning machine following a yarn rupture wherein the apparatus includes an operating unit including a spinning rotor for producing yarn, a bobbin for receiving the yarn produced, means for supporting the bobbin for having yarn wound thereon and for rotating the bobbin;

a delivery device located after the rotor in the yarn path between the rotor and the bobbin;

the apparatus further includes an attending device adapted to travel to the operating unit; the attending device comprising a yarn end detecting device on the attending device, the yarn end detecting device including a yarn end detecting nozzle adapted to be placed near the circumference of the bobbin for detecting a yarn end there;

a yarn transfer device on the attending device for bringing the yarn to the spinning rotor at the operating station;

means for enabling rotation of the bobbin in the unwinding direction and for applying tension to the yarn during the unwinding;

means for trimming an end of the yarn that is on the bobbin and which end is to be spun-in;

the yarn transfer device comprising a rotatable guide roller for the yarn adapted to be embraced by the yarn wrapping around the roller.

17. The apparatus of claim 16, wherein the yarn transfer device comprises a spinning-in head and the guide roller is rotatably mounted on the head, the spinning-in head is so mounted on the attending device as to be swingable through an angle between a position closer to the bobbin and a position closer to the spinning rotor, the guide roller including a circumference which partly interferes with the yarn between the bobbin and the detecting nozzle when the spinning-in head is in the position more toward the bobbin and away from the spinning rotor.

18. The apparatus of claim 17, wherein the spinning-in head is swingable through an angle of 90° between its positions.

19. Apparatus for spinning-in yarn on an open end spinning machine following a yarn rupture, wherein the apparatus includes an operating unit including a spinning rotor for producing yarn, a bobbin for receiving the yarn produced, means for supporting the bobbin for having yarn wound thereon and means for rotating the bobbin in a winding direction; a yarn delivery device between the rotor and the bobbin for receiving yarn from the rotor and delivering the yarn toward the bobbin;

an operating unit attending device adapted to travel to and away from the operating unit, the attending device comprising a yarn end detecting device, including a detecting nozzle movable toward and away from the bobbin to be placed near the circumference of the bobbin for detecting the yarn end and for being moved away from the bobbin for aiding in spinning-in the yarn end;

a yarn transfer device on the attending device between the bobbin and the detecting nozzle along the path of the yarn to the detecting nozzle, the yarn transfer device comprising:

means operable for enabling the bobbin to rotate in the unwinding direction in a manner permitting a metered length of the yarn to be unwound from the bobbin;

a yarn reserve building device for metering the length of the yarn required for spinning-in, the metering device comprising a yarn catching rod movable across the yarn path, disposed between the bobbin and the nozzle and also movable toward and away from the bobbin;

a spinning-in head supported on the attending device, a yarn guide roll supported on the spinning-in head for applying tension to the yarn during the unwinding of the yarn from the bobbin; the spinning-in head being swingable between a first position closer to the bobbin and a second position closer to the spinning-in rotor;

a clamp on the spinning-in head for clamping the yarn after a metered length of the yarn has been unwound from the bobbin and passes around the tension roller;

a cutting device on the spinning-in head for cutting a spinning-in end of the yarn after the yarn end has been clamped; and the spinning-in head also being movable toward the rotor to a position generally between the rotor and the delivery device for bringing the spinning-in end of the yarn to the rotor, the rotor being adapted to receive the spinning-in end of the yarn and to spin-in the end of the yarn along with further yarn being fed through the rotor, thereby to reform the yarn for being wound on the bobbin.

20. The apparatus of claim 19, further comprising an ancillary compensator rotatably mounted to rotate in the plane perpendicular to the axis of rotation of the bobbin in a forward direction for deflecting the yarn and in a reverse direction for releasing the yarn.

21. The apparatus of claim 19, wherein the ancillary compensator includes a compensation arm swingably mounted on the attending device;

an extension spring connected with the arm for biasing the arm in the direction of yarn deflection from the yarn path;

a reverse drive for selectively acting on the compensation arm with a force greater than that of the extension spring and in the opposite direction as the spring.

22. The apparatus of claim 19, wherein the yarn end detecting nozzle is a suction nozzle which sucks the yarn end into the nozzle and sucks the portion of the yarn which has been cut when the yarn end is formed.

23. The apparatus of claim 19, wherein the clamping device is operable for unclamping the yarn when the yarn end is at the rotor and the compensator is adapted to release the yarn when the yarn is at the rotor.

24. The apparatus of claim 19, wherein there are a plurality of the operating units along the machine, and the attending device is selectively movable to any one of the operating units for acting on the operating unit.

* * * * *